US006897613B2

(12) United States Patent
Wada et al.

(10) Patent No.: US 6,897,613 B2
(45) Date of Patent: May 24, 2005

(54) DISCHARGE LAMP, LIGHT SOURCE AND PROJECTING DISPLAY UNIT

(75) Inventors: Mitsuhiro Wada, Katano (JP); Suguru Nakao, Itami (JP); Toshiaki Ogura, Hirakata (JP); Takeharu Tsutsumi, Katano (JP)

(73) Assignee: Matsushita Electric Industrial Co., Ltd. (JP)

( * ) Notice: Subject to any disclaimer, the term of this patent is extended or adjusted under 35 U.S.C. 154(b) by 6 days.

(21) Appl. No.: 10/366,351

(22) Filed: Feb. 14, 2003

(65) Prior Publication Data

US 2003/0155864 A1 Aug. 21, 2003

Related U.S. Application Data

(62) Division of application No. 09/441,041, filed on Nov. 16, 1999, now Pat. No. 6,559,600.

(30) Foreign Application Priority Data

Nov. 17, 1998 (JP) ..... 10-325734
Dec. 10, 1998 (JP) ..... 10-351047

(51) Int. Cl.[7] ..... H01J 61/073

(52) U.S. Cl. ..... 313/631; 313/634; 313/25; 313/573; 313/113; 313/332; 313/46; 313/620

(58) Field of Search ..... 313/631, 634, 313/643, 25, 570, 573, 113, 332, 491, 574, 620, 46, 39; 362/296, 307, 310, 341

(56) References Cited

U.S. PATENT DOCUMENTS

| | | | | |
|---|---|---|---|---|
| 4,977,346 A | | 12/1990 | Gibson et al. | 313/25 |
| 5,093,601 A | | 3/1992 | Watanabe et al. | 313/25 |
| 5,117,154 A | * | 5/1992 | Thomas et al. | 313/634 |
| 5,399,931 A | * | 3/1995 | Roberts | 313/46 |
| 5,689,154 A | | 11/1997 | Barthelmes et al. | 313/112 X |
| 5,721,465 A | * | 2/1998 | Roberts | 313/46 |
| 6,281,620 B1 | | 8/2001 | Yeh | 313/113 |
| 6,281,629 B1 | * | 8/2001 | Tanaka et al. | 313/631 |

FOREIGN PATENT DOCUMENTS

| | | |
|---|---|---|
| JP | 44-30956 | 12/1969 |
| JP | 49-11981 | 2/1974 |
| JP | 5-325891 | 12/1993 |
| JP | 7-240188 | 9/1995 |
| JP | 8-124533 | 5/1996 |
| JP | 8-153487 | 6/1996 |
| JP | 9-153348 | 6/1997 |
| JP | 10-92377 | 4/1998 |
| JP | 10-92378 | 4/1998 |
| JP | 10-106493 | 4/1998 |
| JP | 2820864 | 8/1998 |
| JP | 10-294013 | 11/1998 |

* cited by examiner

*Primary Examiner*—Ashok Patel
(74) *Attorney, Agent, or Firm*—Parkhurst & Wendel, L.L.P.

(57) ABSTRACT

A discharge lamp of the present invention, which has an starting property, an arc stability and a service life which are improved even if the lamp produces a short arc. The discharge lamp includes a light emitting bulb, sealing members disposed on both sides of the light emitting bulb, metal foils sealed in the sealing members, a pair of electrodes which are connected to the metal foils and have large-diameter portions formed on tips, coils disposed at the rear of the large-diameter portions of the electrodes, external conductors, and a discharge medium enclosed in the light emitting bulb.

17 Claims, 18 Drawing Sheets

PRIOR ART

PRIOR ART

DISCHARGE LAMP, LIGHT SOURCE AND PROJECTING DISPLAY UNIT

This is a divisional of application Ser. No. 09/441,041 filed Nov. 16, 1999, now U.S. Pat. No. 6,559,600.

FIELD OF THE INVENTION

The present invention relates to a discharge lamp, a light source apparatus which prepares illumination rays using the discharge lamp, and a projection display apparatus which projects a large image onto a screen using the light source apparatus, a spatial light modulating element (for example, a liquid crystal element) for forming an optical image with video signals supplied from outside, and a projector lens.

BACKGROUND OF THE INVENTION

A small discharge lamp which is denoted by a metalhalide lamp or an ultra high pressure mercury vapor lamp is widely utilized as a light source for a projection display apparatus and the like. In such a case, it is general to combine the discharge lamp with a concave reflector to compose a light source apparatus and utilize this apparatus as a light source for the projection display apparatus.

FIG. 17 exemplifies a configuration of a conventional discharge lamp. A discharge lamp 321 is configured mainly by a light emitting bulb 301, sealing members 302 and 303, metal foils 304 and 305, electrodes 306 and 307, external conductors 308 and 309, and discharge media 310, 311 and 312. Quartz glass is used as the light emitting bulb 301 and sealing members 302, 303, tungsten is used as the electrodes 306 and 307, molybdenum foils are used as the metal foils 304 and 305, and molybdenum is used as the external conductors 308 and 309. Furthermore, mercury, a light emitting metals such as a metalhalide or the like, and a rare gas such as argon or the like, are used mainly as the discharge media 310, 311 and 312, respectively.

When a predetermined voltage is applied across the external conductors 308 and 309, arc discharge takes place between the electrodes 306 and 307, whereby the mercury 310 and the metal halide 311 emit rays characteristic thereof. The argon gas 312 is used to improve a starting characteristic.

Since a distance is extremely short between the electrodes and a high current is supplied at a start time in this kind of discharge lamp, the lamp-is liable to be blackened due to deformation of the electrodes and evaporation of an electrode substance, and can hardly have a long service life. In contrast, there have been disclosed various kinds of lamps which are configured to have service lives prolonged by contriving structures of electrodes (for example by JPA 7-192688 and JPA 10-92377). FIGS. 18 through 20 are enlarged views exemplifying configurations of the electrodes.

FIG. 18 shows an example wherein a coil 331 is disposed around a tip of an electrode 330 to enhance a heat dissipation property, thereby preventing a tip portion from being deteriorated or deformed due to excessive temperature rise.

FIG. 19 shows an example wherein a discharge portion 342 which has a diameter larger than that of an electrode shaft 341 is formed at a tip of an electrode 340 to enhance a thermal conductivity, thereby preventing a tip portion from being deteriorated or deformed due to excessive temperature rise. This kind of electrode is used as an anode of a DC type discharge lamp.

FIG. 20 shows an example wherein a discharge member 352 having a diameter larger than that of an electrode shaft 351 is formed by winding a coil thick around a tip of an electrode 350 and fusing a tip portion so as to form a lump integral with an electrode shaft 351, and a heat dissipating member 353 is formed after the discharge member 352 by integrally fusing a coil, thereby preventing the electrode from being deteriorated or deformed. The heat dissipating member 353 is configured by a coil or a cylindrical electrode member.

However, the electrodes which have configurations shown in FIGS. 18 through 20 pose problems which are described below.

In case of the configuration shown in FIG. 18, a contact area between the electrode 330 and the coil 331 is narrow, whereby the electrode has a low thermal conductivity and cannot exhibit a sufficient heat dissipating effect. Furthermore, the electrode poses a problem that the coil 331 is fused and deformed when the coil 331 is too thin. Though this problem can be solved by thickening the coil 331, tungsten which is used as a material of the electrode 330 is hard and the coil 331 can hardly be wound when it is thick. Furthermore, the electrode poses another problem that a spot of arc discharge moves to the tip of the electrode or an end of the coil, whereby an arc is hardly be stable.

In case of the configuration shown in FIG. 19, the discharge member 342 which is too thick makes the electrode 340 hardly be heated to a temperature required to emit thermoelectrons, thereby posing a problem of degradation of a starting property and interception of discharge. This is remarkably problematic when a lamp is to be lit with an alternating current in particular, whereby the electrode can hardly be used for lighting a lamp with an alternating current.

In case of the configuration shown in FIG. 20 wherein the discharge member 352 is formed integrally and continuously with the coil 353, the discharge portion 352 and the coil 353 have high thermal conductivities and are hardly be raised to a temperature required to emit thermoelectrons, thereby degrading a starting property or allows discharge to be intercepted in the course like the structure shown in FIG. 19. This poses a serious problem when a discharge lamp is to be ignited with an alternating current in particular. Furthermore, an electrode such as that shown in FIG. 20 is manufactured by allowing the electrode having the coil 353 wound around the electrode shaft 351 to discharge in an atmosphere of an inert gas such as nitrogen gas or argon so as to fuse the tip portion. A doping agent such as thorium is often added to tungsten as electrode material for a discharge lamp to improve a starting property. However, the electrode manufactured by the method described above poses a problem that the doping material is evaporated at a stage to fuse the tip portion. Furthermore, the electrode poses another problem that the fusing promotes recrystallization of the tip portion, whereby the electrode is low in its strength and can hardly be worked.

When this kind of discharge lamp is to be used in a projection display apparatus, on the other hand, it is general to configure a light source by combining the discharge lamp with a concave reflector. FIG. 21*a* exemplifies a configuration of a light source. FIG. 21*b* is a sectional view taken along an A—A line in FIG. 21*a*. A reflective coating 372 which is formed on an inside surface of a concave reflector 371 reflects rays emitted from a lamp 360 in a predetermined direction with a high efficiency. A lamp insertion port 373 and a conductor outlet port 374 are formed in the concave reflector 371. The lamp 360 is fixed to the concave reflector 371 with a heat-resistant adhesive agent 375 after inserting a sealing member 362 is inserted into the lamp insertion port 373. Furthermore, an end of an extension conductor 376 is connected to an external conductor 369 and the other end of the extension conductor 376 is led out of the concave reflector 371 through the conductor outlet port 374. Rays can be emitted from the lamp 360 by applying a predetermined voltage across an external conductor 368 and the extension conductor 376.

It is desired that a lamp which is to be used in the projector display apparatus is as small as possible and has a long service life. However, the conventional light source shown in FIG. 21*a* poses problems which are described below.

First, the conventional light source poses a problem that oxidation of metal foils 364 and 365 disposed at both ends of the lamp 360 as well as the external conductors 368 and 369 results in wire breakage, thereby shortening a service life of the lamp. In case of the light source shown in FIG. 21*a*, distortion is produced by a thermal stress at a sealing stage, whereby a gap B is formed between the external conductor 369 and a sealing member 363 as illustrated in FIG. 21*b* showing an enlarged sectional view taken along the A—A line. Accordingly, the external conductor 369 and an end of the metal foil 365 on a side of the external conductor 369 are kept in contact with air, whereby oxidation of these parts is accelerated in an extremely high temperature condition while the lamp stays lit. When molybdenum is used as the metal foils, for example, the oxidation results in wire breakage in a time of about 5000 hours in air heated to 350° C. though the time is variable dependently on a temperature. The external conductor 368 and the sealing member 362 are also oxidized in the similar manner.

While the discharge lamp used in the projection display apparatus stays lit, the lamp is generally kept at an extremely high temperature and heats a light emitting bulb 361 to a temperature close to 1000° C. at maximum. Accordingly, temperatures reach hundreds of degrees in the vicinities of connected portions between the metal foils 364, 365 and the external conductors 368, 369 due to heat conduction from the light emitting bulb 361 as well as electrodes 366 and 367. Though the temperatures can be lowered by forcible air cooling with a fan or the like, evaporation of the light emitting metal is suppressed and a light emitting efficiency is remarkably lowered when the temperature of the light emitting bulb 361 is lowered. Therefore, it is therefore required to cool the lamp extremely locally with high delicacy.

In order to solve this problem, the conventional discharge lamp uses sufficiently long metal foils, thereby reducing temperature rise due to the heat conduction and preventing the wire breakage due to the oxidation. However, the conventional discharge lamp has a total length which is prolonged by the long metal foils and poses a problem that the lamp makes it difficult to configure a light source compact.

Secondly, the conventional light source poses another problem that evaporation of the light emitting metal which is evaporated while the lamp stays lit enhances an internal pressure of the light emitting bulb to an extremely high level, for example, of several MPas (mega pascals) in case of the metalhalide lamp or of scores of MPas (mega pascals) in case of the super-high pressure mercury lamp, thereby making the light emitting bulb liable to be broken while the lamp stays lit.

DISCLOSURE OF THE INVENTION

A primary object of the present invention is to provide a discharge lamp which is improved in a starting property, an arc stability and service life even when it uses a short arc. Another object of the present invention is to provide a light source apparatus which is suited for use mainly in a projection display apparatus, compact and highly reliable, and efficiently condense rays emitted from a discharge lamp. The light source apparatus according to the present invention makes it possible to provide a projection display apparatus which is bright, compact and highly reliable.

A first discharge lamp according to the present invention is a lamp comprising a light emitting bulb, sealing members disposed at both ends of the light emitting bulb, a pair of electrodes which are disposed in the light emitting bulb so as to oppose to each other at a predetermined spacing and a discharge medium enclosed in the light emitting bulb, wherein the electrode is configured by an electrode shaft and a discharge member which is formed integrally with a tip of the electrode shaft and has an outside diameter larger than that of the electrode shaft, and has a heat dissipating conductor which is disposed at the rear of the discharge member so as to surround the electrode shaft.

A second discharge lamp according to the present invention is a lamp comprising a light emitting bulb, sealing members disposed at both ends of the light emitting bulb, a pair of electrodes which are sealed in the sealing members and disposed in the light emitting bulb so as to oppose to each other at a predetermined spacing and a discharge medium enclosed in the light emitting bulb, wherein the electrode is composed of an electrode shaft and a discharge member which is formed integrally with a tip of the electrode shaft and has an outside diameter larger than that of the electrode shaft, the discharge member has a taper formed on its tip, a heat dissipating conductor surrounding the electrode shaft is disposed at the rear of the discharge member and the electrode satisfies the following conditions:

$$\phi/L \leqq 0.6$$

$$20° \leqq \theta \leqq 60°$$

where the reference symbol L denotes the spacing between the electrodes disposed in the light emitting bulb, the reference symbol $\phi$ denotes a diameter of the tip of the discharge member, and the reference symbol $\theta$ denotes an angle formed between the tapered tip and the electrode shaft.

A third discharge lamp according to the present invention is a lamp comprising a light emitting bulb, sealing members which are disposed at both ends of the light emitting bulb, a pair of electrodes which are sealed in the sealing members and disposed in the light emitting bulb so as to oppose to each other at a predetermined spacing and a discharge medium enclosed in the light emitting bulb, wherein the electrode is composed of an electrode shaft and a cylindrical conductor fitted over a tip of the electrode shaft, and a heat dissipating conductor is disposed at the rear of the cylindrical conductor so as to surround the electrode shaft.

A fourth discharge lamp according to the present invention is a lamp comprising a light emitting bulb, sealing members which are disposed at both ends of the light emitting bulb, a pair of electrodes which are sealed in the sealing members and disposed in the light emitting bulb so as to oppose to each other at a predetermined spacing and a discharge medium enclosed in the light emitting bulb, wherein the electrode has an electrode shaft, a cylindrical conductor which is fitted over a tip of the electrode shaft and has a tapered outside diametrical portion on a side of the tip of the electrode shaft, a heat dissipating conductor surrounding the electrode shaft is disposed at the rear of the cylindrical conductor and the electrode satisfies the following conditions:

$\phi/L \leqq 0.6$ $20° \leqq \theta > 60°$ where the reference symbol L denotes the spacing between the electrodes disposed in the light emitting bulb, the reference symbol $\phi$ denotes an outside diameter which is closer to the tip of the electrode shaft in the cylindrical conductor, and the reference symbol $\theta$ denotes an angle formed between the tapered tip and the electrode shaft.

A fifth discharge lamp according to the present invention is a lamp comprising a light emitting bulb, sealing members disposed at both ends of the light emitting bulb, a pair of electrodes which are sealed in the sealing members and disposed in the light emitting bulb so as to oppose to each other at a predetermined spacing, and mercury and a rare gas which are enclosed in the light emitting bulb, wherein the mercury is enclosed in an amount of 150 mg/cc or more, and the electrode is composed of an electrode shaft and a discharge member which is formed integrally with a tip of the electrode shaft and has an outside diameter larger than that of the electrode shaft, the discharge member has a tapered tip, a heat dissipating conductor surrounding the electrode shaft is disposed at the rear of the discharge member, and the electrode satisfies the following conditions:

$\phi/L \leqq 0.6$ $20° \leqq \theta \leqq 60°$ where the reference symbol L denotes the spacing between the electrodes, the reference symbol $\phi$ denotes a diameter of the tip of the discharge member, and the reference symbol $\theta$ denotes an angle formed between the tapered tip and the electrode, and wherein the discharge lamp is configured to be lit by applying an AV voltage across the electrodes.

It is preferable for the third or fourth discharge lamp described above that a taper is formed on an inside end which is far from the tip of the electrode shaft.

It is preferable for any of the first through fifth discharge lamps described above that the heat dissipating conductor has a form of a coil.

It is preferable for any of the first through fifth discharge lamps described above that the electrodes and the heat dissipating conductor are made of different materials.

It is preferable for any of the first through fifth discharge lamps described above that the electrodes are made of tungsten doped with thorium.

Furthermore, it is preferable for any of the first, second or fifth discharge lamps described above that the spacing between the electrodes does not exceed 2 mm and that the electrode satisfies the following conditions:

$2.0 \leqq D2/D1 \leqq 5.0$ $D3/D1 \leqq 9.0$ where the reference symbol D1 denotes an outside diameter of the electrode shaft, the reference symbol D2 denotes an outside diameter of the discharge member, and the reference symbol D3 denotes a length of the discharge member as measured in a direction of the electrode shaft.

It is preferable for the third or fourth discharge lamp described above that the spacing between the electrode does not exceed 2 mm and that the electrode satisfies the following conditions:

$2.0 \leqq D2/D1 \leqq 5.0$ $D3/D1 \leqq 9.0$ where the reference symbol D1 denotes an outside diameter of the electrode shaft, the reference symbol D2 denotes an outside diameter of the cylindrical conductor, and the reference symbol D3 denotes a length of the cylindrical conductor as measured in a direction of the electrode shaft.

It is preferable for any of the first through fourth discharge lamps described above that the discharge medium is mercury and a rare gas.

It is preferable for any of the first through fourth discharge lamps described above that the lamp is lit by applying an AC voltage across the electrodes.

It is preferable for any of the first through fourth discharge lamps described above that the lamp is lit by applying a DC voltage across the electrodes and that a polarity of the voltage is reversed, depending on a drive time and a number of ignitions.

It is preferable for any of the first through fifth discharge lamps described above that the electrode is made of pure tungsten having a content of at least one of potassium, silicon and aluminium which does not exceed 10 ppm.

The present invention is capable of providing a discharge lamp which is excellent in a starting property and has a long service life even if it uses a short arc.

A first light source apparatus according to the present invention comprises any of the first through fifth discharge lamps described above and a concave reflector which reflects rays emitted from the discharge lamp in predetermined directions.

A second light source apparatus according to the present invention comprises the second, fourth or fifth discharge lamp described above and a concave reflector which reflects rays emitted from the discharge lamp in predetermined directions, and is characterized in that the concave reflector has an opening through which reflected rays are emitted and a lamp insert portion which is disposed on a side opposite to the opening, that the discharge lamp is disposed so that its one end is inserted into the lamp insert portion and a center of a light emitting area formed between the electrodes is approximately coincident with a shorter focal point of the concave reflector and that rays which are emitted from the center of the light emitting area and incident onto an effective reflecting surface of the concave reflector are not intercepted by the electrodes of the discharge lamps.

A third light source apparatus according to the present invention is an apparatus comprising a discharge lamp and a concave reflector which reflects rays emitted from the discharge lamp in predetermined directions, wherein the discharge lamp comprises metal foils which are sealed in sealing members disposed at both ends of a light emitting bulb and different in lengths, the concave reflector has an opening through which reflected rays are emitted and a lamp insert hole disposed on a side opposite to the opening, and the discharge lamp is disposed so that a sealing member in which a metal foil having a shorter length is sealed is inserted into the lamp insert hole and a center of a light emitting area formed in the light emitting bulb is approximately coincident with a shorter focal point of the concave reflector.

A fourth light source apparatus according to the present invention is an apparatus comprising a discharge lamp, a concave reflector which reflects rays emitted from the discharge lamp in predetermined directions and light transmittal enclosing means which is disposed in an opening for emitting rays reflected by the concave reflector to form a enclosed space in the concave reflector, wherein an inert gas is enclosed in the closed space.

A fifth light source apparatus according to the present invention is an apparatus comprising a discharge lamp, a concave reflector which reflects rays emitted from the discharge lamp in predetermined directions and light transmittal enclosing means which is disposed in an opening for emitting rays reflected by the concave reflector to form an enclosed space in the concave reflector, wherein a gas is enclosed in the enclosed space at a pressure higher than an atmospheric pressure and lower than a working pressure of the discharge lamp.

A sixth light source apparatus according to the present invention is an apparatus comprising a discharge lamp having a working pressure not lower than 10 MPas (mega pascals) a concave reflector which reflects rays emitted from the discharge lamp in predetermined directions and transmittal enclosing means, wherein the discharge lamp has metal foils which are disposed at both ends of a light emitting bulb and different in lengths, the concave reflector has an opening for emitting rays reflected by the concave reflector and a lamp insert hole disposed on a side opposite to the opening, the discharge lamp is disposed so that a sealing member in which a metal foil having a shorter length is sealed is inserted into the lamp insert hole and a center of a light emitting area formed in the light emitting bulb is approximately coincident with a shorter focal point of the concave reflector.

It is preferable for the fourth or fifth light source apparatus described above that the concave reflector is an ellipsoidal mirror.

It is preferable for the fourth or fifth light source apparatus described above that the discharge lamp has a working pressure which is not lower than 10 MPas (mega pascals).

It is preferable for the third or sixth light source apparatus described above that the concave reflector is an ellipsoidal mirror and a distance as measured from a vertex of the lamp insert portion of an ellipsoidal to an end of a longer metal foil on a side of the opening of the concave reflector does not exceed ½ of a length of a major axis of the ellipsoidal surface.

The present invention makes it possible to obtain a light source apparatus which is capable of effectively condensing rays emitted from a lamp. Furthermore, the present invention makes it possible to obtain a light source apparatus which is compact and highly reliable.

A projection display apparatus according to the present invention is an apparatus comprising a light source, image forming means which is illuminated with the light source and forms an optical image in correspondence to video signals and projecting means which projects an optical image formed on the image forming means to a screen, characterized in that the light source is any of the first through sixth light source apparatus described above.

The present invention makes it possible to obtain a projection display apparatus which is compact, highly reliable and bright.

DESCRIPTION OF THE EMBODIMENTS

Now, the preferred embodiments of the present invention will be described with reference to the accompanying drawings.

Figure 1A:
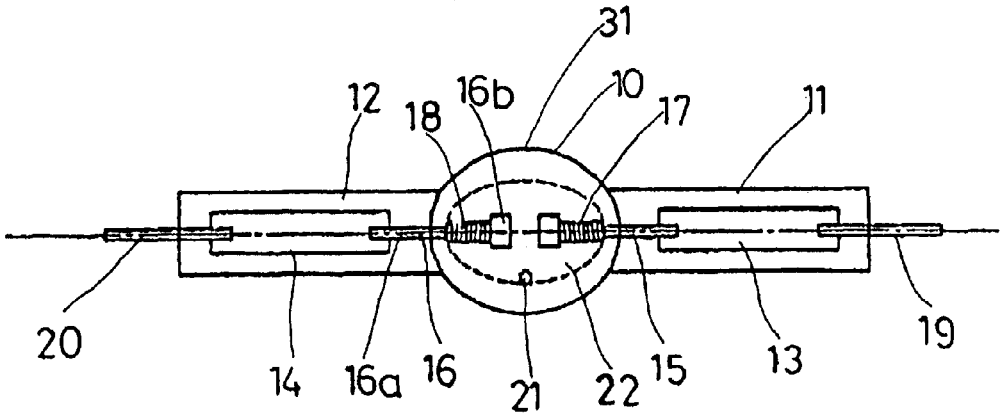
FIG. 1*a* is a schematic configurational view showing a first embodiment of a discharge lamp according to the present invention.
Figure 1B:
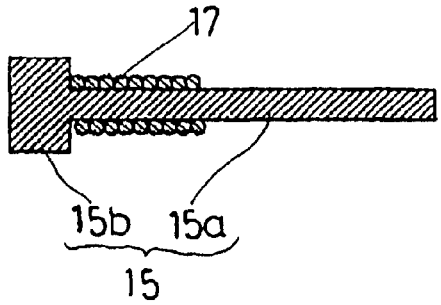
FIG. 1*b* is an enlarged view showing a configuration of an electrode in the first embodiment.

FIGS. 1*a* and 1*b* exemplify a configuration as a first embodiment of a discharge lamp according to the present invention. FIG. 1*b* is an enlarged sectional showing an electrode used in the first embodiment shown in FIG. 1*a*.

A reference numeral 10 denotes a light emitting bulb, reference numerals 11 and 12 denote sealing members, reference numerals 13 and 14 denote metal foils, reference numerals 15 and 16 denote electrodes, reference numerals 17 and 18 denote coils adopted as heat dissipating conductors, reference numerals 19 and 20 denote external conductors, reference numerals 21 and 22 denote mercury and argon gas used as discharge media, and a reference numeral 31 denotes a discharge lamp according to the present invention.

The light emitting bulb 10 is a bulb of transparent quartz glass which has an outside diameter of 15 mm, a maximum thickness of 3 mm and an spherical or ellipsoidal internal discharge space. The transparent quartz glass is excellent in heat resistance and suited as a material for the discharge lamp which is used at an extremely high working temperature. The transparent quartz glass has another merit to have high light transmittance. Another material having a high thermal conductivity such as sapphire glass may be used. A high thermal conductivity provides a merit that it uniformalizes a temperature distribution in the light emitting bulb 10, thereby stabilizing a light emitting characteristic and facilitating to cool the light emitting bulb 10.

The sealing members 11 and 12 are disposed at both ends of the light emitting bulb 10. Like the light emitting bulb 10, the sealing members 11 and 12 are made of the transparent quartz glass. The metal foils 13 and 14 13.5 mm wide by 16 mm long are sealed in the sealing members 11 and 12, respectively. The metal foils 13 and 14 are made of molybdenum which is a metal having a high fusion point.

Ends of the electrodes 15 and 16 are connected to the metal foils 13 and 14, and the other ends of the electrodes are disposed in the light emitting bulb 10 so as to oppose to each other at a interval distance of 2.0 mm. The electrode 15 is composed of an electrode shaft 15*a* and a discharge member 15*b* which has a diameter larger than that of the electrode shaft and is formed integrally with the electrode shaft as shown in FIG. 1*b*. Pure tungsten is used as a material for the electrode 15. The electrode 15 can be obtained easily by cutting a cylindrical electrode material. Furthermore, the electrode 15 having a predetermined form may be molded using molding dies made of molybdenum, carbon or a ceramic material. The electrode shaft 15*a* and the discharge member 15*b* have outside diameters of 1.0 mm and 3.0 mm, respectively. The discharge member 15*b* is 1.8 mm long in an axial direction. At the rear of the discharge member 15*b*, a coil 17 is wound around the electrode shaft 15*a*. The coil 17 is made of pure tungsten wire having a diameter of 0.5 mm. The coil 17 may be fixed to the electrode shaft 15*a*, for example, by spot welding. The electrode 16 is composed similarly of an electrode shaft 16*a* and a discharge member 16*b* which has a diameter larger than that of the electrode shaft 16*a*, and a coil 18 is wound around the electrode shaft 16*a* at the rear of the discharge member 16*b*.

Each of the ends of the external conductors 19 and 20 is connected to the metal foils 13 and 14 and the other end of the external conductors protrude out of the sealing members 11 and 12, respectively. Like the metal foils 13 and 14, the external conductors 19 and 20 are made of molybdenum. By applying a predetermined voltage across the external conductors 19 and 20, it is possible to allow an arc discharge to take place between the electrodes 15 and 16, thereby obtaining emission characteristic of the mercury 21 as it is evaporated. Furthermore, the argon gas 22 is enclosed as a rare gas at a predetermined pressure to improve a starting property of the lamp.

In addition to argon gas, an inert gas such as xenon gas may be used as a rare gas, which can improve the starting property. Furthermore, a predetermined amount of halogen gases, for example, iodine, bromine and chlorine may be enclosed together with the rare gas mentioned above. The halogen gases serve to prolong a service life of the lamp since the gases combined with tungsten used as the material for the electrodes and produce a halogen cycle, thereby preventing an inside wall of the light emitting bulb from being blackened due to splashing of tungsten while the lamp stays lit.

Figure 17:
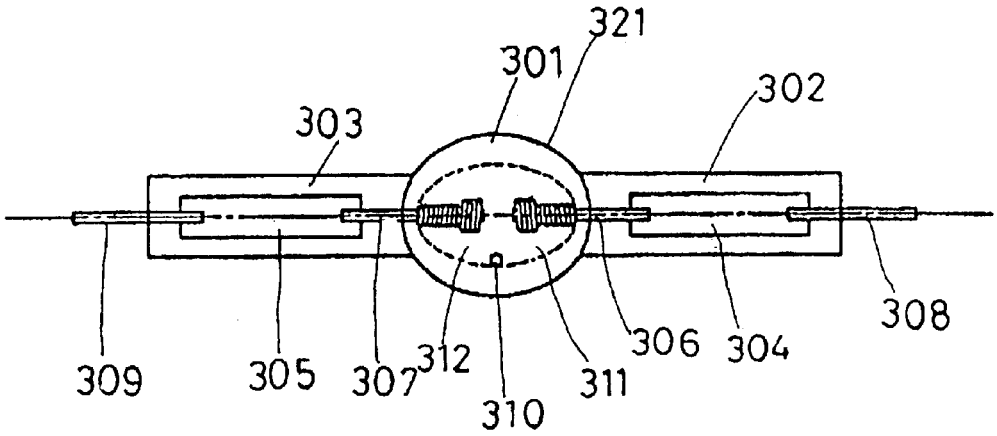
FIG. 17 is a schematic view showing a configuration of a conventional discharge lamp.
Figure 18:
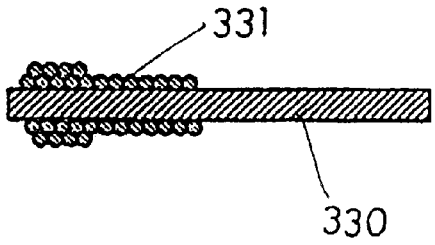
PRIOR ART FIG. 18
FIG. 18 is a schematic view showing a configuration of an electrode of a conventional discharge lamp.
Figure 19:
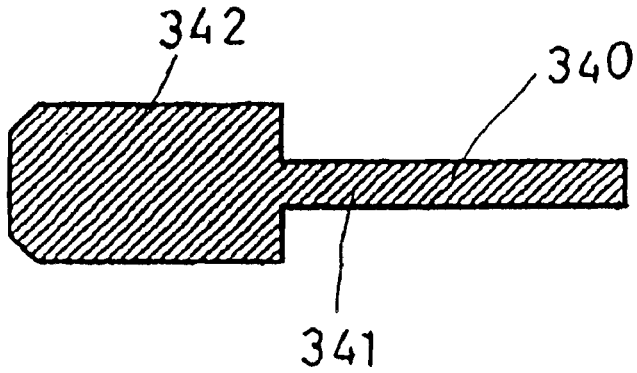
FIG. 19 PRIOR ART
FIG. 19 is a schematic view showing another configuration of the electrode of the conventional discharge lamp.
Figure 20:
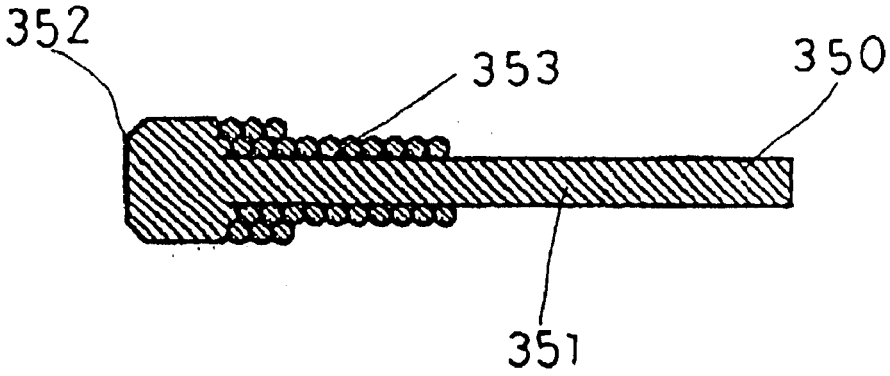
FIG. 20 PRIOR ART
FIG. 20 is a schematic view showing still another configuration of the electrode of the conventional discharge lamp.
Figure 21B:
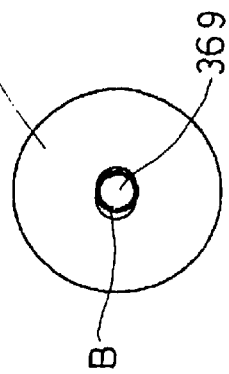
FIG. 21*b* is an enlarged sectional view taken along an A—A line in FIG. 21*a*.
Figure 21A:
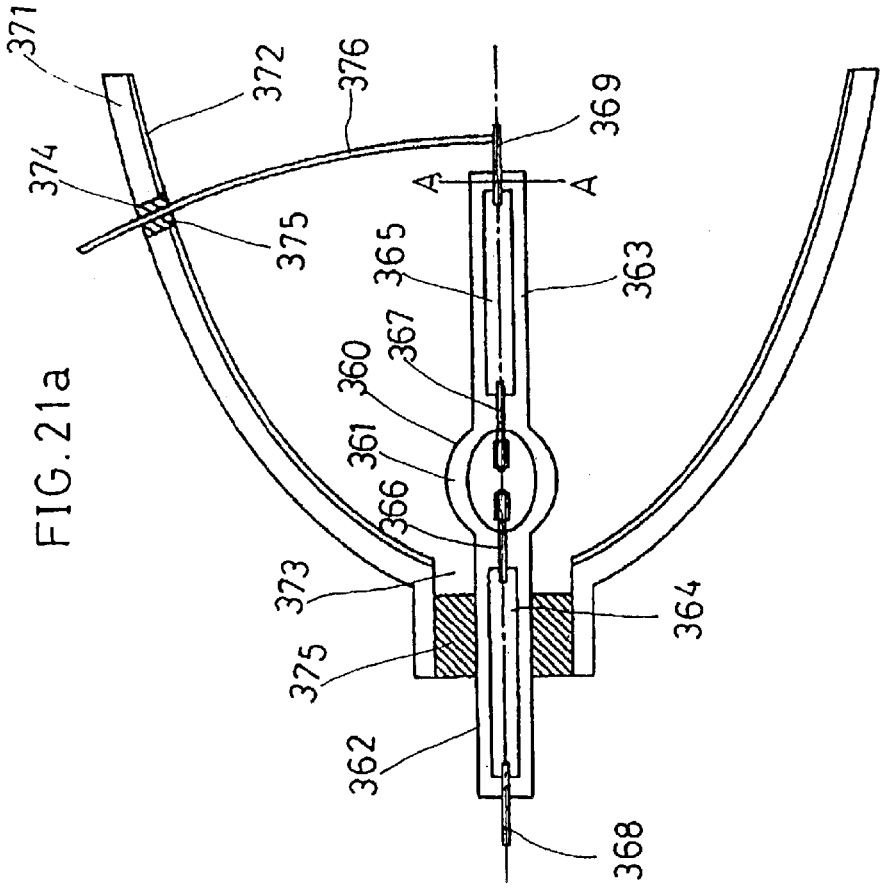
PRIOR ART FIG. 21a
FIG. 21*a* is a schematic view showing a configuration of a conventional light source apparatus.

When the discharge lamp 31 is composed using the electrodes 15 and 16, a light emitting area formed by arc discharge between the discharge members 15*b* and 16*b* which have the large diameter. Since the discharge members 15*b* and 16*b* have a large thermal capacity and a high thermal conductivity, the discharge members exhibit an effect to suppress overheat of the electrodes 15 and 16 even if a relatively high current is supplied Accordingly, the discharge members remarkably reduce deformation of the electrodes 15 and 16 and evaporation of an electrode substance, thereby prolonging the service life of the lamp. The coils 17 and 18 which enhance a heat dissipating property of the electrode shafts 15*a* and 16*a* to suppress overheat of the electrodes, thereby preventing the electrode shafts from being thinned or broken. Furthermore, the electrodes 15 and 16 do not make an arc spot unstable unlike the electrode shown in FIG. 17, thereby being capable of stabilizing light emission. Since the electrodes 15 and 16 are not fused integrally with the coils 17 and 18 but kept separate from the coils, the discharge members 15*b*, 16*b* and the coils 17, 18 have low thermal conductivities. Furthermore, since the discharge members 15*b* and 16*b* have a form which is adequately selected so that these members do not have too large a thermal capacity, the discharge members 15*b* and 16*b* are not cooled excessively and can easily be heated to a temperature sufficient for emission of thermoelectrons, thereby remarkably improving a starting property as compared with that obtained with an electrode shown in FIGS. 19 and 20.

The configuration according to the present invention makes it possible to obtain a discharge lamp which is excellent in a starting property and has a long service life despite of a shorter arc, using electrodes which are composed of electrode shafts and discharge members formed integrally with tips of the electrode shafts and having a diameter larger than that of the electrode shafts, and disposing heat dissipating conductors after the discharge members so as to surround the electrode shafts as described above.

Figure 2A:
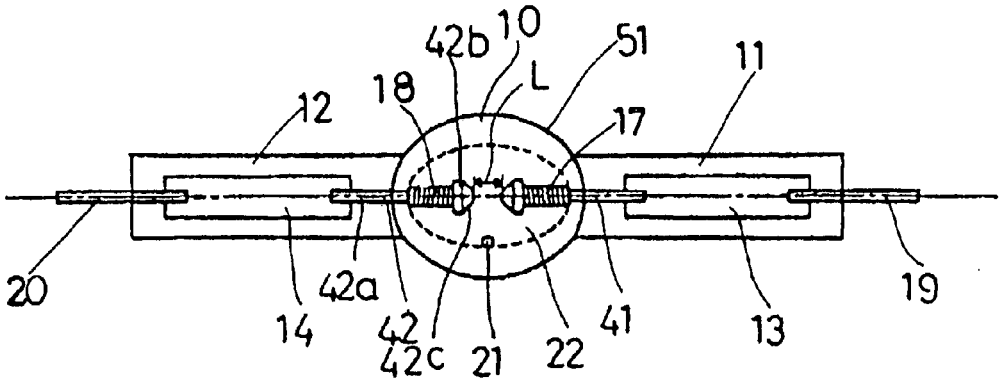
FIG. 2*a* is a schematic configurational view showing a second embodiment of the discharge lamp according to the present invention.
Figure 2B:
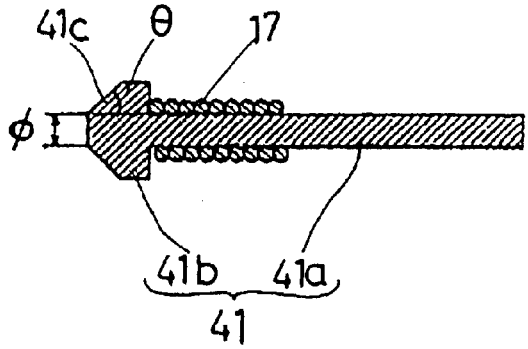
FIG. 2*b* is an enlarged view showing a configuration of the electrode in the second embodiment.

FIGS. 2*a* and 2*b* exemplify a configuration of a second embodiment of the discharge lamp according to the present invention. Incidentally, FIG. 2*b* is an enlarged sectional view illustrating an electrode member shown in FIG. 2*a*.

A discharge lamp 51 has a configuration which is the same as that shown in FIG. 1*a*, except electrodes 41 and 42. Different from the electrode shown in FIG. 1*a*, the electrode 41 has a taper 41*c* formed on a tip of a discharge member 41*b* which composes the electrode 41. The taper 41*c* is formed at an angle of 45° relative to an electrode shaft 41*a* and the tip of the discharge member 41*b* has a circular sectional shape having a diameter of 1.0 mm. Like the electrode 41, the electrode 42 has a taper 42*c* which is formed at angle of 45° relative to an electrode shaft 42*a*.

The second embodiment provides, in addition to those obtained with the embodiment shown in FIGS. 1*a* and 1*b*, effects which are described below. When the tapers 41*c* and 42*c* are formed on the tips of the discharge members 41*b* and 42*b* to reduce a diameter $\phi$ of the tips, an electron emission property is enhanced and a starting property is improved as compared with that of the embodiment shown in FIGS. 1*a* and 1*b*. Simultaneously, the tapers also remarkably shorten a rise time required until the lamp reaches a stable state. Since thermoelectrons are emitted mainly from the tips of the discharge members 41*b* and 42*b*, the tapers provide a merit to remarkably reduce a diametrical width of an arc is remarkably reduced as compared with that of an arc which is produced without the tapers 41*c* and 42*c*, thereby enhancing luminance of a light emission area. Furthermore, the discharge members 41*b* and 42*b* which have the small diameter ϕ hardly allow movement of an arc spot the tips, or the so-called bright point movement, thereby enhancing arc stability during ignition of the lamp. Furthermore, the tapers can narrow a range wherein rays emitted from the light emitting area are intercepted by the discharge members 41*b* and 42*b* which have the large diameter, thereby making it possible to utilize the emitted rays with a high efficiency. In addition, the tapers allow the electrodes to be worked easier than the electrode shown in FIG. 20, thereby enhancing production yield of the electrodes.

In order to obtain sufficient effects of the present invention, it is sufficient to satisfy the following conditions:

$$\phi/L \leqq 0.6 \quad \text{(Equation 1)}$$

$$20° \leqq \theta \leqq 60° \quad \text{(Equation 2)}$$

where the reference symbol L denotes a spacing between the electrodes 41 and 42 disposed in the light emission bulb 10, the reference symbol ϕ denotes a diameter of the tips of the discharge members 41*b* and 42*b*, and the reference symbol θ denotes an angle formed between the tapers 41*c*, 42*c* and the electrode shafts 41*a* and 42*a*.

ϕ/L which is larger than an upper limit value of the Equation 1 is not preferable since it lowers the effects for the starting property, rise time and arc stability described above. Furthermore, ϕ/L which is larger than the upper limit is not preferable since it increases an amount of rays to be intercepted by the discharge members 41*b* and 42*b*.

θ which is smaller than a lower limit value of the Equation 2 is not preferable since it makes the tips of the discharge members 41*b* and 42*b* too thin, thereby allowing the electrodes 41 and 42 to be easily deteriorated. Furthermore, θ which is larger than an upper limit value of the Equation 2 is not preferable since it lowers the effects for the starting property, rise time and arc stability. Furthermore, θ larger than the upper limit value is not preferable since it increases the amount of rays to be intercepted by the discharge members 41*b* and 42*b*.

Figure 3:
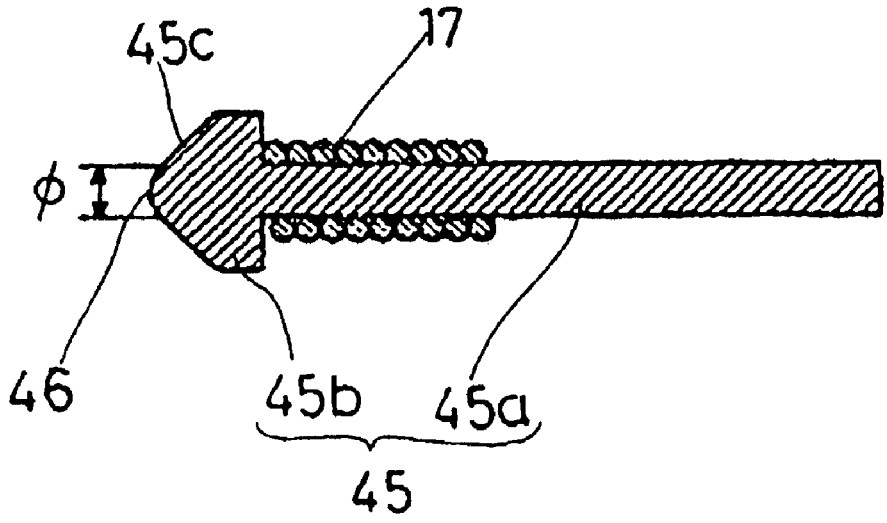
FIG. 3 is an enlarged view showing another configuration of an electrode in the second embodiment.

The electrode may be an electrode 45 which has a spherical tip as shown in FIG. 3. In case of this electrode, a diameter ϕ of a tip of a discharge member 45*b* is to be defined as a distance between tangential points between an outer circumference 46 of a sphere and a taper 45*c*.

As described above, according to the configuration of the present invention, the electrode is used which comprises the electrode shaft and the discharge member which is formed integrally with the tip of the electrode shaft, has an outside diameter larger than that of the electrode shaft and has a taper, and the heat dissipating conductor is provided at the rear of the discharge member so as to surround the electrode shaft. Thereby, the discharge lamp can be realized which is easily manufactured, does not induce unstable discharge, is excellent in a starting property and rise time performance, is capable of efficiently utilizing emitted rays and is long in a service life even with a short arc.

Figure 4A:
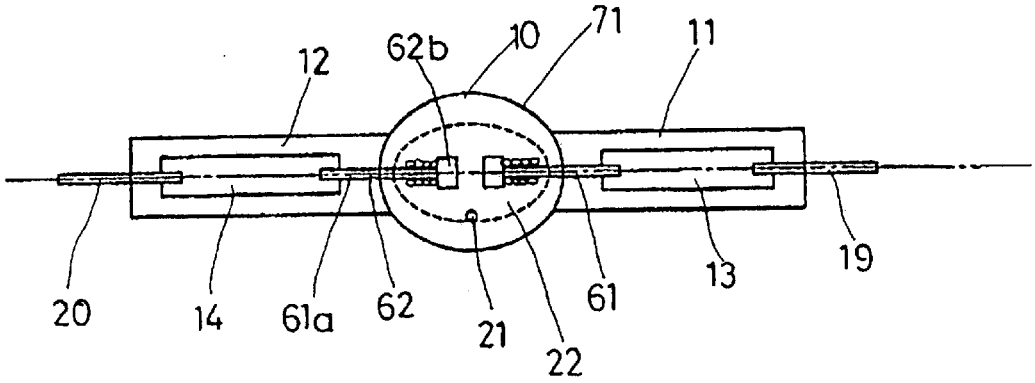
FIG. 4*a* is a schematic configurational view showing a third embodiment of the discharge lamp according to the present invention.
Figure 4B:
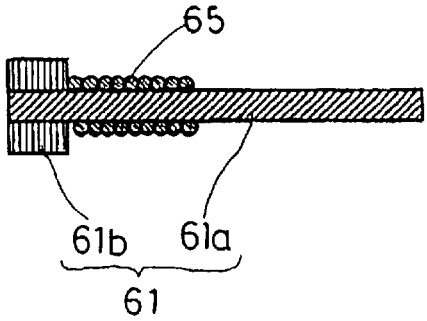
FIG. 4*b* is an enlarged view showing a configuration of an electrode in the third embodiment.

FIGS. 4*a* and 4*b* show an example of configuration illustrating a third embodiment of the discharge lamp according to the present invention. FIG. 4*b* is an enlarged sectional view of an electrode shown in FIG. 4*a*.

A discharge lamp 71 has a configuration which is the same as that shown in FIG. 1*a*, except electrodes 61 and 62. Different from the electrode shown in FIG. 1*a*, the electrode 61 is configured by an electrode shaft 61*a* and a cylindrical conductor 61*b* which is disposed on a tip of the electrode shaft 61*a*. The electrode shaft 61*a* has an outside diameter of 1.0 mm and is made of pure tungsten. The cylindrical conductor 61*b* has an outside diameter of 3.0 mm. The cylindrical conductor 61*b* is 1.8 mm long as measured in an axial direction, made of pure tungsten and fitted over the tip of the electrode shaft 61*a*. The cylindrical conductor 61*b* can be fixed to the electrode shaft 61*a*, for example, by spot welding. Like the electrode 61, the electrode 62 has a cylindrical conductor 62*b* disposed at a tip thereof.

Heat which is generated by the electrode shafts 61*a* and 62*a* is dissipated by way of the cylindrical conductors 61*b* and 62*b*. Since the electrode shafts 61*a* and 62*a* have a high contact property and a high thermal conductivity, heat is dissipated efficiently from the tips of the electrode shafts 61*a* and 62*a* which are heated to a highest temperature. The electrode uses the tip which is configured separate from the electrode shaft unlike the electrode shown in FIG. 1*b* and eliminates a necessity to form the tip by cutting, thereby providing a merit that it can be manufactured easier.

The electrode 61*b* allows heat conducted after the electrode shaft 61*a* to be dissipated efficiently by disposing a heat dissipating conductor such as a coil 65, thereby being capable of preventing the electrode shaft 61*a* from being thinned or broken. The electrode 62 also exhibits a similar effect.

Though end surfaces of the electrode shafts 61*a* and 62*a* are slush with end surfaces of the cylindrical conductors 61*b* and 62*b* in FIGS. 4*a* and 4*b*, the cylindrical conductors may be fitted so that the tips of the electrode shafts 61*a* and 62*a* protrude slightly from the end surfaces of the cylindrical conductors 61*b* and 62*b*.

Figure 5:
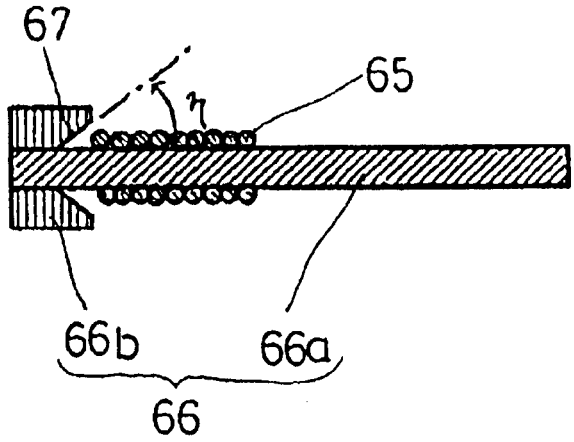
FIG. 5 is an enlarged view showing another configuration of the electrode in the third embodiment.

The electrode 61 can be configured as an electrode 66 shown in FIG. 5 which uses a cylindrical conductor 66*b* having a notched taper 67 formed on an inner circumference on a side farther from a tip of an electrode shaft 66*a*. The taper 67 provides an effect to further enhance a heat dissipating property by enlarging a surface area of the cylindrical conductor 66*b*. Simultaneously, a starting property can further be improved by adjusting an angle η of the taper 67 so as to obtain an adequate contact area between the electrode shaft 66*a* and the cylindrical conductor 66*b*. A heat dissipating conductor such as the coil 65 may be disposed at the rear of the cylindrical conductor 66*b*. The electrode 62 can also be configured similarly.

Figure 6:
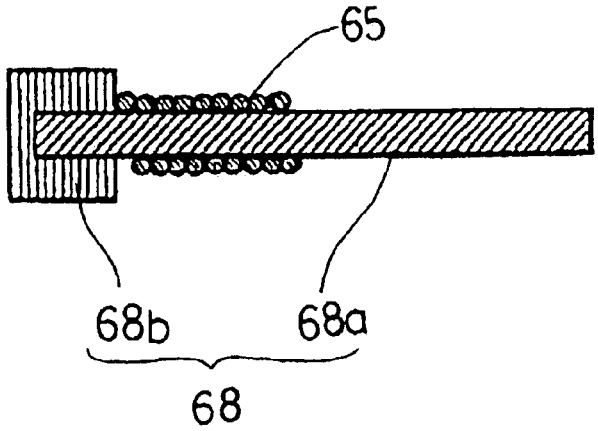
FIG. 6 is an enlarged view showing still another configuration of the electrode in the third embodiment.

Furthermore, similar effects can be obtained with an electrode 68 composed by fitting a tip of an electrode shaft 68*a* into a cylindrical conductor 68*b* having an inner circumference which does not run through the conductor as shown in FIG. 6. It is possible to dispose a heat dissipating conductor such as the coil 65 and an inner circumferential taper similar to that shown in FIG. 5.

The configuration according to the present invention makes it possible to obtain a discharge lamp which is easily manufactured, does not induce unstable discharge, and has an excellent starting property and a long service life despite of the shorter arc, using the electrodes composed of the electrode shafts and the cylindrical conductors fitted over the tips of the electrode shafts.

Figure 7A:
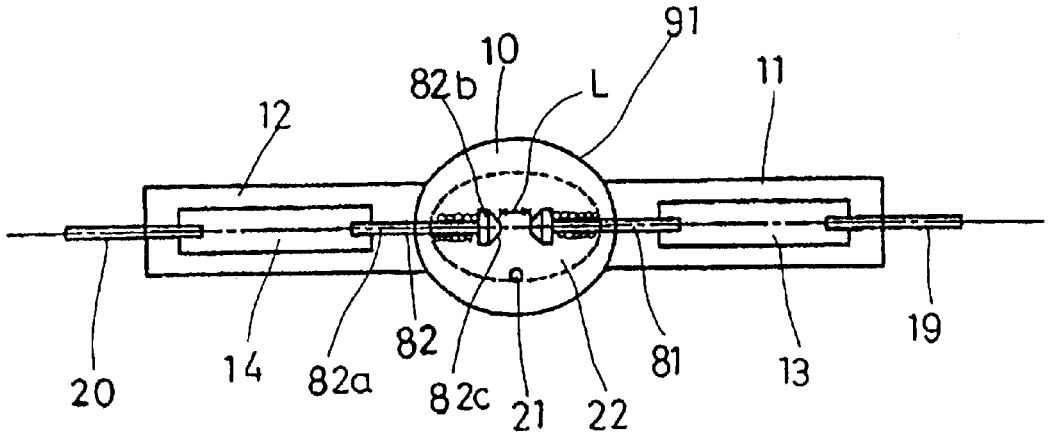
FIG. 7*a* is a schematic configurational view showing a fourth embodiment of the discharge lamp according to the present invention.
Figure 7B:
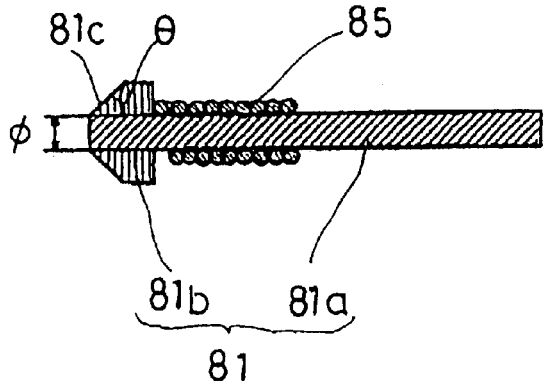
FIG. 7*b* is an enlarged view showing a configuration of an electrode in the fourth embodiment.

FIGS. 7*a* and 7*b* show an example of configuration of a fourth embodiment of the discharge lamp according to the present invention. Incidentally, FIG. 7*b* is an enlarged sectional view of an electrode shown in FIG. 7*a*.

A discharge lamp 91 has a configuration which is the same as that shown in FIG. 4*a*, except for electrodes 81 and 82. Different from the electrode shown in FIG. 4*a*, the electrode 81 uses a cylindrical conductor 81*b* which has a taper 81*c* on its tip. The taper 81*c* is formed at an angle of 45° relative to an axial line of the electrode 81 and a tip of the cylindrical conductor 81*b* has an outside diameter of 1.0 mm which is the same as an outside diameter of an electrode shaft 81*a*. Like the electrode 81, the electrode 82 has a taper 82*c* formed on a cylindrical conductor 82*b*. A heat dissipating conductor such as a coil 85 which is disposed at the rear of the cylindrical conductor 81*b* serves to efficiently dissipate heat conducted backwards the electrode shaft 81*a*, thereby being capable of preventing the electrode shaft 81*a* from being thinned or broken. The electrode 82 is configured similarly.

The fourth embodiment not only provides the effect of the third embodiment shown in FIGS. 4*a* and 4*b* but also further improves a starting property and a rise time. Simultaneously, the fourth embodiment provides a merit to enhance luminance of alight emitting area. Furthermore, the fourth embodiment hardly allows a bright point to move, thereby enhancing an arc stability during ignition of the lamp. Furthermore, the fourth embodiment narrows an area at which rays emitted from a light emitting area are intercepted by the cylindrical conductors 81*b* and 82*b*, thereby making it possible to efficiently utilize the emitted rays.

To obtain sufficient effects of the present invention, it is sufficient to satisfy the following conditions:

$$\phi/L \leqq 0.6 \quad \text{(Equation 3)}$$

$$20° \leqq \theta \leqq 60° \quad \text{(Equation 4)}$$

where the reference symbol L denotes a spacing between the electrodes 81 and 82 disposed in the light emitting bulb 10, the reference symbol $\phi$ denotes an outside diameter of end surfaces of the cylindrical conductors 81*b* and 82*b* close to the tips of the electrode shafts 81*a* and 82*a*, and the reference symbol $\theta$ denotes an angle formed between the tapers 81*c*, 82*c* and the electrodes 81, 82.

$\phi/L$ which is larger than an upper limit value of the Equation 3 is not preferable since it lowers the effects for the starting property, rise time and arc stability described above. Furthermore, $\phi/L$ which is larger than the upper limit value is not preferable since it increases an amount of rays to be intercepted by the cylindrical conductors 81*b* and 82*b*.

$\theta$ which is smaller than a lower limit value of the Equation of the 4 is not preferable since it makes the tips of the cylindrical conductors 81*b* and 82*b* too thin, thereby making the electrodes 81 and 82 liable to be deteriorated. In contrast, $\theta$ which is larger than an upper limit value of the Equation 4 is not preferable since it lowers the effect for the starting property, rise time and arc stability described above. Furthermore, $\theta$ which is larger than the upper limit value is not preferable since is increases an amount of rays to be intercepted by the cylindrical conductors 81*b* and 82*b*.

The configuration according to the present invention makes it possible to obtain a discharge lamp which can easily be manufactured, does not induce unstable discharge, is excellent in a starting property and rising performance at an ignition time, permits efficiently utilizing emitted rays and has a long service life even with a short arc using the electrode composed of the electrode shaft and the cylindrical conductors which have the tapered outside diametrical portions on the side of the tip of the electrode shaft as described above.

Figure 8A:
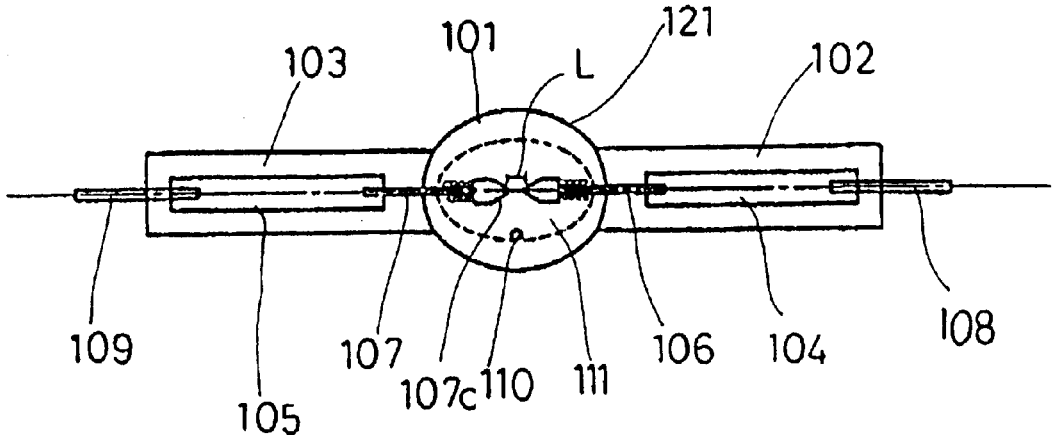
FIG. 8*a* is a schematic configurational view showing a fifth embodiment of the discharge lamp according to the present invention.
Figure 8B:
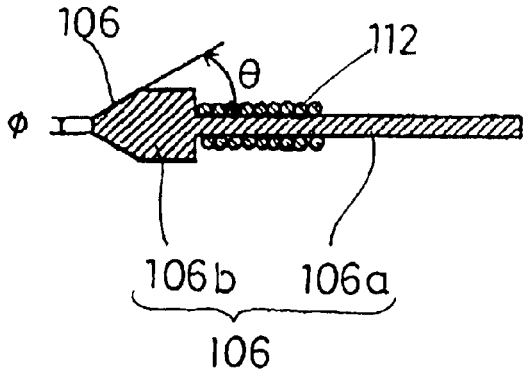
FIG. 8*b* is an enlarged view showing a configuration of an electrode in the fifth embodiment.

FIGS. 8*a* and 8*b* exemplify a configuration which is a fifth embodiment of the discharge lamp according to the present invention. Incidentally, FIG. 8*b* is an enlarged sectional view of an electrode shown in FIG. 8*a*.

A discharge lamp 121 is an ultra high pressure mercury vapor lamp to be ignited with an AC current. Ultra high pressure mercury vapor lamps are compact and highly luminant at light emitting areas, thereby being used widely for projection display apparatuses. Generally speaking, this kind of lamps are used mainly for horizontal lighting.

A light emitting bulb 101 is a quartz glass bulb having an outside diameter of 12 mm and a maximum thickness of 2.5 mm, and a molybdenum foils 104 and 105 of 2.5 mm wide by 20 mm long are enclosed in sealing members 102 and 103. Electrodes 106 and 107 which are connected to the molybdenum foils 104 and 105 and made of pure tungsten are disposed so as to oppose to each other in the light emitting bulb 101 at an interval distance of 1.5 mm. Enclosed in the light emitting bulb 101 are mercury at 170 mg/cc, argon gas at 200 mb and an extremely fine amount of bromine. Bromine serves to prevent an inside wall of the light emitting bulb 101 from being blackened by tungsten evaporated from the electrodes 106 and 107, thereby prolonging a service life of the lamp 121.

Mercury 110 can be glowed by applying an AC voltage having a predetermined frequency across external conductors 108 and 109 which are connected to the molybdenum foils 104 and 105. The lamp 121 is set at an electric power of 200 W in its stable state.

The electrode 106 is configured by an electrode shaft 106*a* and a discharge member 106*b* which has a diameter larger than that of the electrode shaft 106*a*. The discharge member 106*a* has a diameter of 0.5 mm. The discharge member 106*b* has an outside diameter of 1.8 mm, a tip diameter of 0.3 mm, a length of 2.5 mm in an axial direction and a taper angle of 30°. A heat dissipating conductor such as a coil 112 is disposed at the rear of the discharge member 106*b* so that heat conducted backwards the electrode shaft 106*a* can be efficiently dissipated, thereby preventing the electrode shaft 106*a* from being thinned or broken. The electrode 107 has a similar configuration.

Since the distance between the electrodes 106 and 107 is as short as 1.5 mm, a light emitting area having remarkably high luminance is formed between the electrodes. By composing the discharge lamp 121 by using the electrodes 106 and 107, it is possible to suppress deterioration of the electrodes and to prolong a service life of the lamp even if the light emitting area has high luminance and the electrodes 106 and 107 generate heat in an extremely large amount. Furthermore, since an adequate form is selected for the discharge member 106*b*, the lamp has a favorable starting property, a short rise time and a high arc stability during ignition. In addition, the lamp can efficiently utilize emitted rays since the electrodes 106 and 107 are configured to intercept rays emitted from the light emitting area only within a narrow area.

Figure 9:
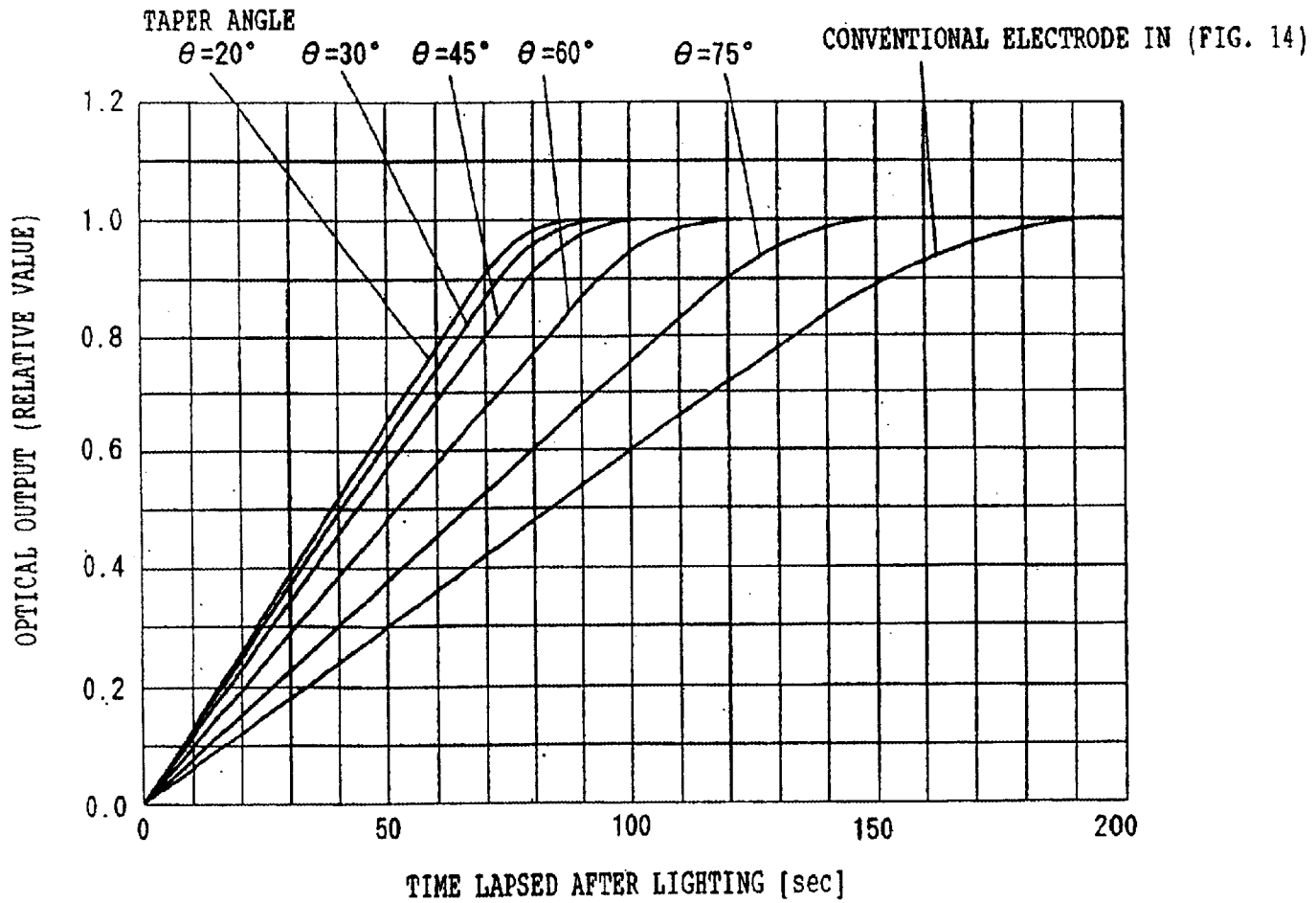
FIG. 9 shows characteristic curves visualizing relationship between taper angles and rise times.

FIG. 9 visualizes relationship between an angle of tapers 106*c*, 107*c* and a rise time with respect to the discharge lamp shown in FIG. 8: an abscissa denoting a time after ignition and an ordinate designating an optical output. The optical output denoted by the ordinate expresses a relative value which is calculated taking an optical output of the lamp in a stable state as 1.0. As compared with a lamp which uses a conventional electrode shown in FIG. 14, the discharge lamp according to the present invention has a remarkably shortened rise time. The rise time is prolonged as the tapers 106*c* and 107*c* have a larger angle, and favorable rising performance can be obtained within a range from 20° to 60° of the angle of the tapers 106*c* and 107*c*.

To obtain sufficient effects of the present invention, it is sufficient to satisfy the following conditions:

$$\phi/L \leqq 0.6 \quad \text{(Equation 5)}$$

$$20° \leqq \theta \leqq 60° \quad \text{(Equation 6)}$$

where the reference symbol L denotes a spacing between the electrodes disposed in the light emitting bulb, the reference symbol $\phi$ denotes a diameter of the discharge member, and the reference symbol $\theta$ denotes an angle formed between the taper and the electrode shaft.

By adopting the electrodes which have the discharge members having a diameter larger than that of the electrode shaft and selecting an adequate form for the discharge members, the configuration according to the present invention makes it possible to obtain a discharge lamp which is excellent in a starting property and rising performance without inducing any unstable discharge, capable of efficiently utilizing rays and long in a service life even with a short arc, even when the lamp is an ultra high pressure mercury vapor lamp or the like which imposes a heavy load on electrodes.

It is preferable that the discharge lamp preferred as the first, second or fifth embodiment has a spacing of 2 mm or shorter between the electrodes and satisfies embodiment described above satisfies the following conditions:

$$2.0 \leqq D2/D1 \leqq 5.0 \quad \text{(Equation 7)}$$

$$D3/D1 \leqq 9.0 \quad \text{(Equation 8)}$$

where the reference symbol D1 denotes an outside diameter of the electrode shaft, the reference symbol D2 denotes an outside diameter of the discharge member, and the reference symbol D3 denotes a length of the discharge member as measured in a direction of the electrode shaft.

Furthermore, it is preferable that the third or fourth embodiment has a spacing of 2 mm or shorter between the electrodes and satisfies the following conditions:

$$2.0 \leqq D2/D1 \leqq 5.0 \quad \text{(Equation 9)}$$

$$D3/D1 \leqq 9.0 \quad \text{(Equation 10)}$$

where the reference symbol D1 denotes an outside diameter of the electrode shaft, the reference symbol D2 denotes an outside diameter of the cylindrical conductor, and the reference symbol D3 denotes a length of the cylindrical conductor as measured in a direction of the electrode shaft.

Since D1 is approximately determined depending on a value of a current to be supplied to electrodes in any case, a form of a discharge member can be selected optimum to improve a starting property.

Furthermore, a metalhalide can be enclosed as a discharge medium other than mercury and the rare gas in the first through fourth embodiments.

A discharge lamp may be ignited with a DC current or an AC current. For comparison with performance of the conventional discharge lamp, ignition with an AC current provides higher effects for a starting property and an arc stability. At the time of lighting with a DC current, a polarity of an input voltage is to be reversed depending on a lighting time and the number of lightings. Symmetry of a light emitting area can be improved and a service life of a lamp can be prolonged by reversing the polarity, for example, at intervals of 100 hours so that deterioration of only one electrode is not accelerated.

Furthermore, it is more preferable in the first through fifth embodiments that tungsten used as the material for the electrodes has smaller contents of impurities such as potassium, silicon and aluminium. These impurities hinder the halogen cycle due to reactions with halogens such as bromine, thereby shortening a service life of the lamps. Furthermore, large contents of the impurities lower a fuse point of tungsten, thereby making the lamps liable to be deteriorated. It is therefore preferable that a content of each impurity does not exceed 10 ppm.

A material other than pure tungsten may be selected for the electrodes. A doping agent such as thorium, for example, may be added to tungsten to improve a starting property of the lamp.

The heat dissipating conductor may not be limited to be a form of a coil. The heat dissipating conductor may, for example, be a cylindrical metal conductor surrounding the electrode shaft which has similarly enhance a heat dissipating property of the electrode shaft.

The heat dissipating conductor may be in contact or not in contact with the discharge member. Favorable starting performance can be obtained when the electrode is completely separate from the heat dissipating conductor.

Different materials may be selected for a main electrode and the heat dissipating conductor. Taking a starting property, a heat dissipating property, workability, etc. into consideration, materials optimum for a purpose of use are to be selected, for example, pure tungsten having an extremely high fuse point for the main electrode and tungsten containing a doping agent such as potassium relatively in a large amount for the heat dissipating conductor to facilitate to form a coil.

Though the discharge lamp which has a symmetrical form has been described above, the sealing members and the metal foils may be different in lengths, and the pair of electrodes may be disposed at locations deviated in any direction.

Figure 10:
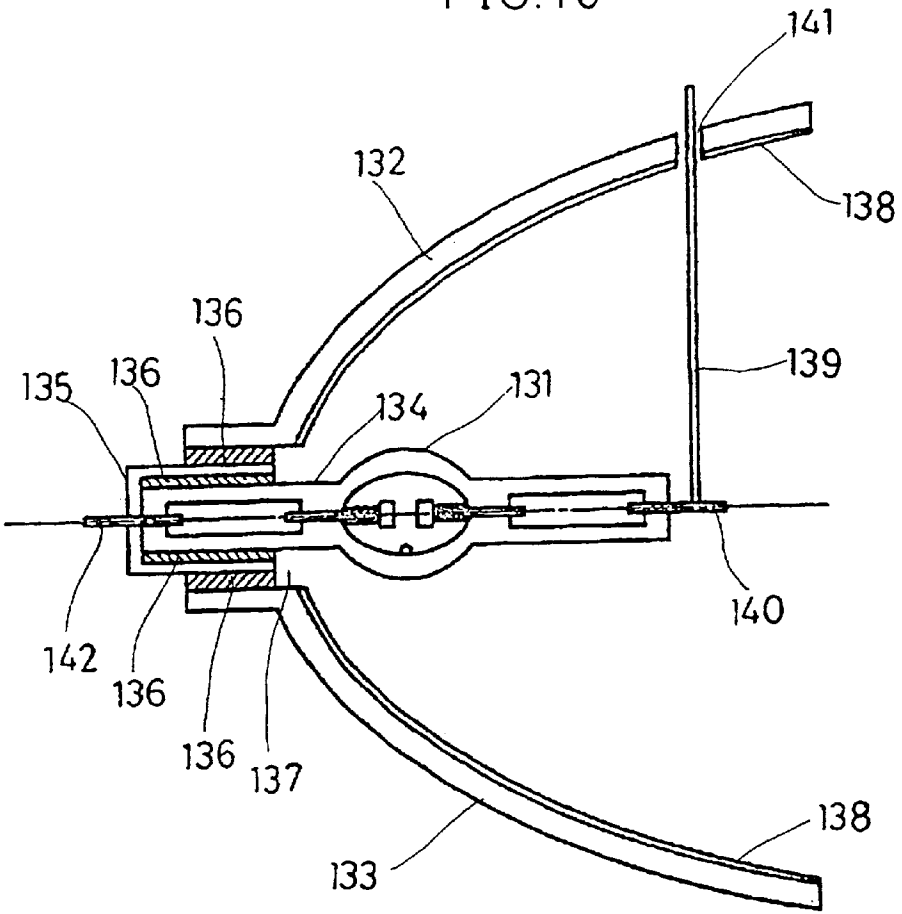
FIG. 10 is a schematic view showing a first embodiment of a light source apparatus according to the present invention.

FIG. 10 exemplifies a configuration of a first embodiment of the light source apparatus according to the present invention. In FIG. 10, a reference numeral 131 denotes a lamp, a reference numeral 132 denotes a concave reflector, and a reference numeral 133 denotes a light source according to the present invention.

The lamp 131 is the same as the discharge lamp shown in FIG. 1*a* and comprises a base 135 fitted over a sealing member 134. The base 135 is fixed with a heat-resistant adhesive agent 136 filled in a gap between the base 135 and the sealing member 134. The sealing member 134 over which the base 135 is fitted is inserted into a lamp insert hole 137 of the concave reflector 132 and fixed with the heat-resistant adhesive agent 136.

Used as the concave reflector 132 is a parabolic mirror or an ellipsoidal mirror. Formed on an inside surface of the concave reflector 132 is a reflective coating 138 comprising of a multi-layer film of a dielectric which reflects rays emitted from the lamp 131 in a predetermined direction at high reflectance. The concave reflector 132 has a large solid angle relative to a light emitting area of the lamp 131 and provides a merit to enhance a condensing ratio.

An extension conductor 139 has an end connected to an external conductor 140 and the other end which is taken out of the concave reflector 132 through a conductor outlet hole 141 of the concave reflector 132. The lamp 131 can be started by applying a predetermined voltage across the extension conductor 139 and an external conductor 142.

Since the lamp 131 has a high arc stability as described above, it can provide a stable illuminating luminous flux which scarcely flickers and is stable in brightness.

Similar effects can be obtained using the discharge lamp according to the present invention as shown in FIGS. 2*a*, 4*a*, 7*a* and 8*a*.

The configuration according to the present invention makes it possible, by using the discharge lamp according to the present invention, to obtain a light source apparatus which integrates the discharge lamp with a concave reflector, and is favorable in a starting property and forms an illuminating luminous flux stable in brightness.

Figure 11:
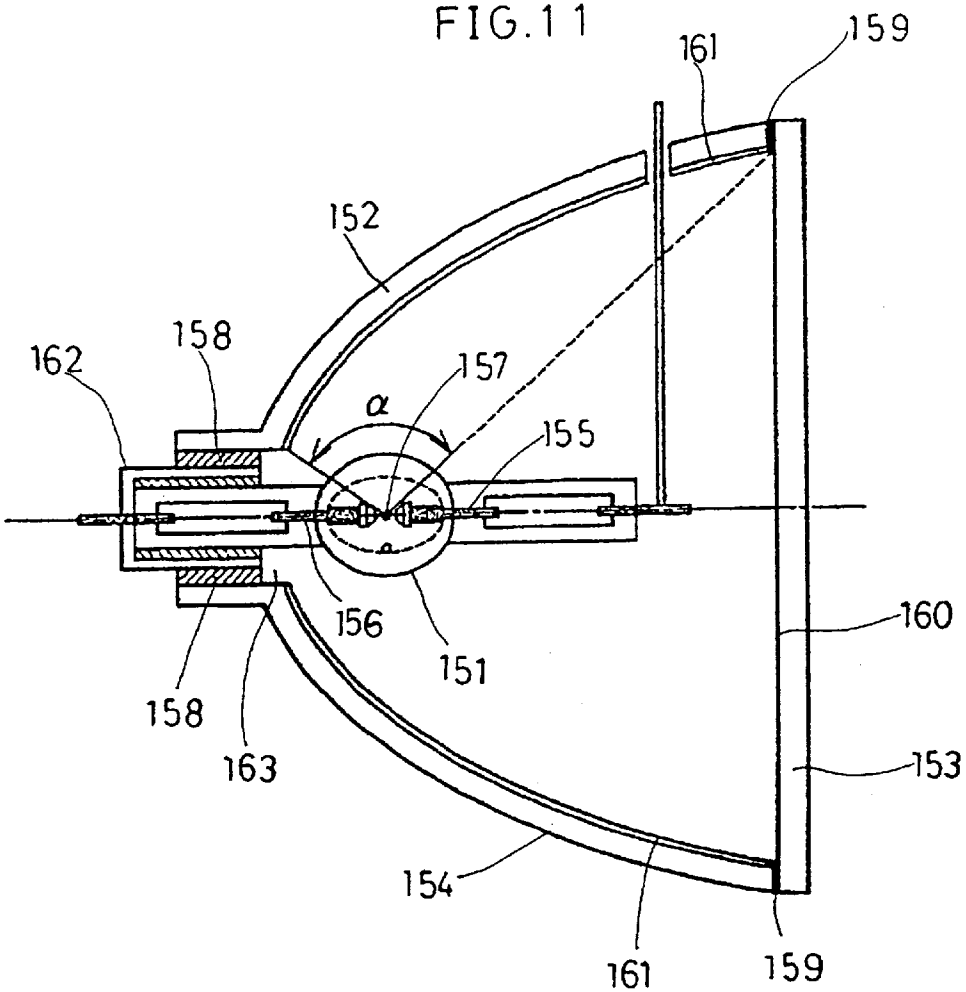
FIG. 11 is a schematic view showing a second embodiment of the light source apparatus according to the present invention.

FIG. 11 exemplifies a configuration of a second embodiment of the light source apparatus according to the present invention. In FIG. 11, a reference numeral 151 denotes a lamp, a reference numeral 152 denotes a concave reflector, a reference numeral 153 denotes a front glass plate, and a reference numeral 154 denotes a light source apparatus according to the present invention.

The lamp 151 has a configuration which is the same as that of the discharge lamp shown in FIG. 2*a*. Used as the concave reflector 152 is an ellipsoidal mirror or a parabolic mirror. The lamp 151 is disposed so that a side over which a base 162 is fitted is inserted into a lamp insert hole 163, and a center of a light emitting area formed between electrodes 155 and 156 is approximately coincident with a first focal point 157 of the concave reflector, and fixed with a heat-resistant adhesive agent 158.

The front glass plate 153 is made of pyrex glass which is excellent in heat resistance and light transmittance, and fixed to an emitting side opening of the concave reflector 152 with a silicon series adhesive agent 159. A coating 160 which reflects ultraviolet rays and transmits visible rays is disposed on a surface of incidence of the front glass plate 153 to prevent detrimental ultraviolet rays out of rays emitted from the lamp 151 from leaking outside. Since a space which is substantially enclosed is formed in the concave reflector by attaching the front glass plate 153 to the emitting side opening of the concave reflector 152, broken pieces of the lamp 151 do not splash outside should the lamp be broken, thereby enhancing security of a light source apparatus 154.

A reflective coating 161 composed of a multi-layer film of a dielectric is formed on an inside surface of the concave reflector 152. Let us assume that a reference symbol $\alpha$ denotes a range of condensation for rays which are emitted from a center of a light emitting area of the lamp 151, concretely a center between the electrodes 155 and 156, and incident on an effective reflecting surface of the concave reflector 152. Since tips of the electrodes 155 and 156 are tapered, rays emitted from the lamp 151 are not intercepted by the electrode 155 and 156 within the range of condensation $\alpha$. Accordingly, the light source apparatus 154 provides merit to effectively utilize the rays emitted from the lamp 151, thereby there is an advantage of enhancing an efficiency to utilize the rays.

Since the range of condensation a is different depending on the form of the concave reflector 152, a taper angle $\theta$ and a tip diameter $\phi$ of the electrodes 155 and 156 are selected adequately so as to satisfy the Equation 2.

Similar effects can be obtained by using the discharge lamp shown in FIG. 7*a* or 8*a* as the lamp 151. In such a case, a form of the electrodes is to be determined so as to satisfy the mathematical formulae 3 and 4 or 5 and 6.

As described above, the configuration according to the present invention makes it possible, by using the discharge lamp according to the present invention, to obtain a light source apparatus which integrates the discharge lamp with a concave reflector, and is favorable in a starting property, forms an illuminating luminous flux stable in brightness and utilizes rays with a high efficiency.

Figure 12:
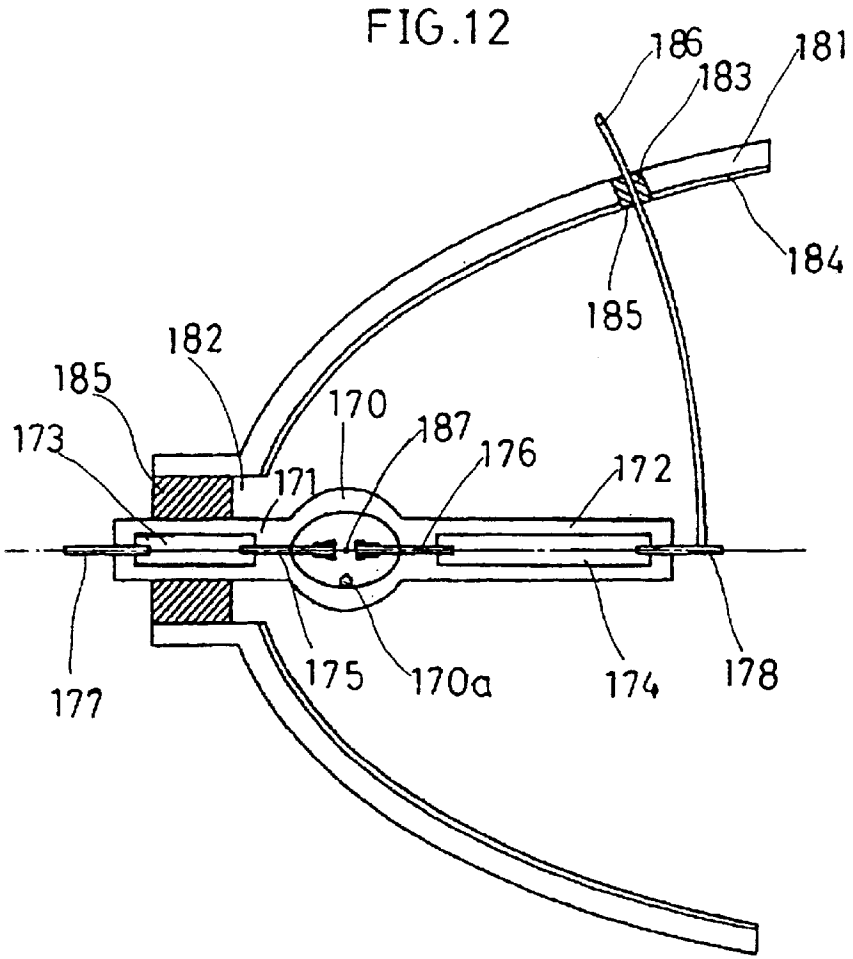
FIG. 12 is a schematic configurational view showing a third embodiment of the light source apparatus according to the present invention.

FIG. 12 exemplifies a configuration of a third embodiment of the light source apparatus according to the present invention. In FIG. 12, a reference numeral 170 denotes a discharge lamp and a reference numeral 181 denotes a concave reflector.

The discharge lamp 170 is disposed and adjusted so that a sealing member 171 to which a short metal foil 173 is sealed is inserted into an insert hole 182 of the concave reflector 181 and a focal point 187 of the concave reflector 181 is approximately coincident with a center between electrodes 175 and 176 of the lamp 170, and fixed with an adhesive agent 185. Used as the adhesive agent 185 is an inorganic heat-resistant adhesive agent such as Sumiserum or the like.

An extension conductor 186 has-an end connected to an external conductor 178 of the discharge lamp 170 and the other end which is pulled outside through a conductor outlet hole 183 of the concave reflector 181. A gap between the conductor outlet hole 183 and the extension conductor 186 is filled with the adhesive agent 185.

Arc discharge is generated between the electrodes 175 and 176 by applying a predetermined voltage to the extension conductor 186 and an external conductor 177, and thereby mercury (Hg) 170*a* which is a discharge medium evaporates, and the light generation peculiar to the mercury 170*a* can be obtained.

The concave reflector 181 has an ellipsoidal surface and mirror has a first focal point F1 at a distance of 15 mm and a second focal point F2 (not shown) at a distance of 140 mm. The ellipsoidal surface generally has two axes of ellipse (a major axis and a minor axis). Lengths of the major and minor axes can be expressed by the following formulae respectively.

$$\text{Length of major axis}=F1+F2 \quad \text{(Equation 11)}$$

$$\text{Length of minor axis}=2\times(F1\times F2)^{1/2} \quad \text{(Equation 12)}$$

An axis of ellipse which contains the first focal point F1 and the second focal point F2 is the major axis, and an axis of ellipse which is perpendicular to the major axis is the minor axis. An ellipsoidal mirror shown in FIG. 12 has a major axis and a minor axis which are 155 mm long and 91.7 mm long respectively. When a metal foil 174 is too long in the ellipsoidal mirror, the foil is located close to the second focal point at which rays are condensed and raised to a high temperature. Therefore, a length is selected for the metal foil 174 so that a distance as measured from a vertex of the ellipsoid on a side of the lamp insert hole 182 to an end of the long metal foil 174 on a side of the opening of the concave reflector does not exceed ½ of the length of the major axis of the ellipsoidal surface.

An inside surface of the concave reflector 181 has a reflective coating 184 made of a multi-layer film of a dielectric and efficiently reflects rays which are emitted from between the electrodes 175 and 176 of the discharge lamp 170.

Though the concave reflector is not limited to the ellipsoidal mirror and may be a parabolic mirror or the like, the ellipsoidal mirror can provide a higher condensing ratio since is can have a larger solid angle relative to a light emitting area of the lamp.

The configuration shown in FIG. 12 wherein the sealing member 171 to which the short metal foil 173 of the discharge lamp 170 is sealed is fixed in the insert hole 182 of the concave reflector shortens a protruding length of the lamp rearward from the insert hole 182, thereby permits configuring the light source apparatus compact. The sealing member 171 can have a sufficient thermal capacity and a sufficient surface area since it is kept in contact with the concave reflector 181. Accordingly, the sealing member 171 is capable of suppressing temperature rise due to heat conduction from the light emitting bulb 170 and cannot be broken even when the short metal foil 173 is sealed in the sealing member 171. On the other, the sealing member 172 on the side of the opening of the concave reflector cannot be broken due to oxidation since the metal foil 174 which is longer than the metal foil 173, or has a sufficient length, is connected to the sealing member 172.

The discharge lamp 170 may comprise a base fitted over the sealing member 171.

As described above, the configuration according to the present invention makes it possible to compose a light source apparatus which is highly reliable and compact by fixing a sealing member in which a short metal foil of a discharge lamp is sealed to a concave reflector.

Figure 13:
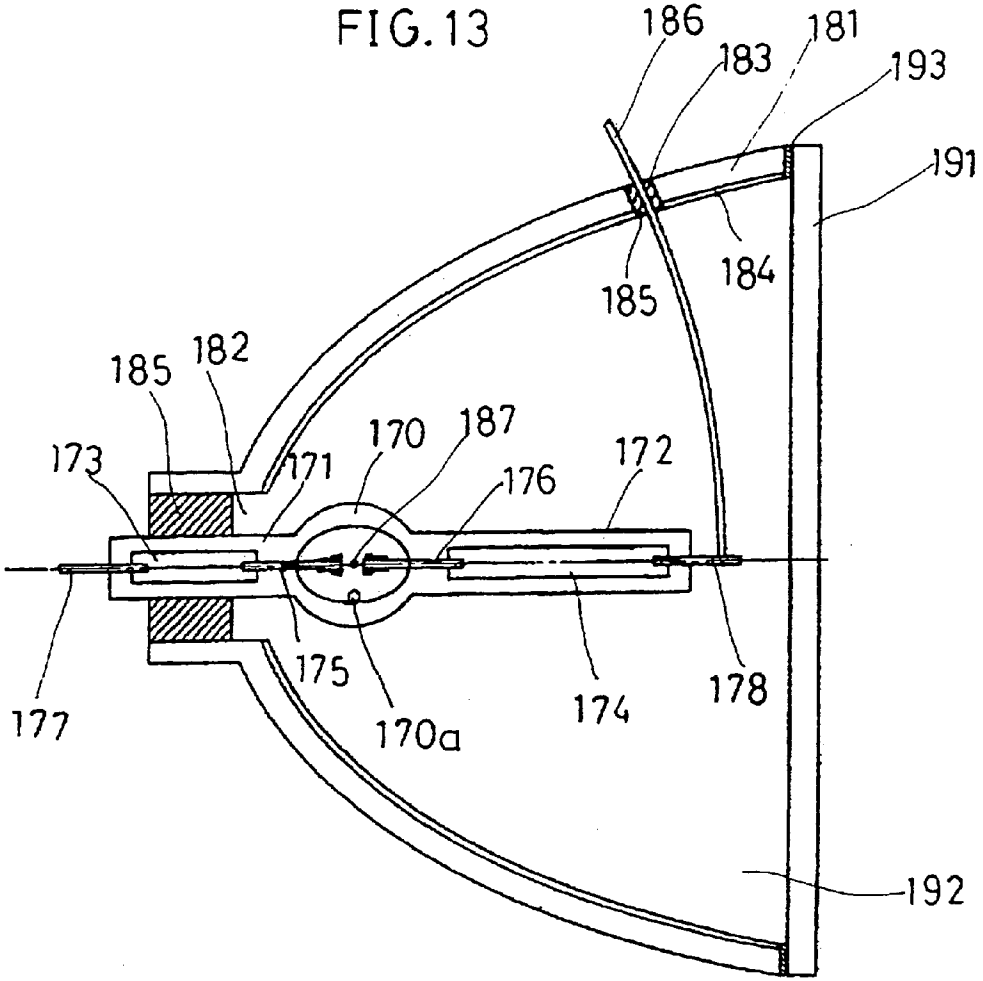
FIG. 13 is a schematic configurational view showing a fourth embodiment of the light source apparatus according to the present invention.

FIG. 13 exemplifies a configuration of a fourth embodiment of the light source apparatus according to the present invention. In FIG. 13, a reference numeral 191 denotes a front glass plate used as enclosing means, a reference numeral 192 denotes nitrogen gas and other components of the fourth embodiment are the same as those shown in FIG. 12.

The front glass plate 191 is made of pyrex which is excellent in thermal resistance and relatively inexpensive, and fixed to an opening of the concave reflector 181 on a side of emitting reflected rays with an adhesive agent 193 such as a silicon resin or the like. The front glass plate 191 formed an enclosed space inside the concave reflector 181, thereby preventing broken pieces from splashing outside even if the discharge lamp is broken while it stays lit.

It is preferable to form a reflective coating which eliminates ultraviolet rays and infrared rays on at least either of planar surfaces of the front glass plate 191 on a side of incidence or emitting rays. The reflective coating is capable of preventing ultraviolet rays and infrared rays from emitting outside. Furthermore, rays emitted from the discharge lamp 170 are allowed to emerge efficiently when an antireflection coating is formed on at least either of the planar surfaces.

The nitrogen gas 192 is enclosed in the enclosed space formed inside the concave reflector 181. The nitrogen gas 192 can be enclosed, for example, by cementing the front glass plate 191 to the concave reflector 181 in a glove compartment after the discharge lamp 170 has been fixed. An inert gas such as argon gas may be used in place of the nitrogen gas 192.

The configuration shown in FIG. 13 wherein the nitrogen gas 192 is enclosed in the enclosed space formed inside the concave reflector 181 is capable of preventing oxidation of the metal foil 174 disposed on the side of the opening of the concave reflector 181.

The concave reflector 181 may be a parabolic mirror or an ellipsoidal mirror: the ellipsoidal mirror which can have a large solid angle relative to a light emitting area of the lamp being capable of enhancing a light condensing ratio. Furthermore, the ellipsoidal mirror permits the concave reflector 181 to have a large depth in a direction of an optical axis and is suited to form an enclosed structure by disposing the front glass plate 191.

The discharge lamp 170 may comprise a base which is fitted over the sealing member 171.

Though the discharge lamp uses the metal foils which have different lengths in the fourth embodiment, the effects described above can be obtained irresitive of the lengths of the metal foils.

The configuration according to the present invention makes it possible to prevent metal foils from being oxidized and compose a highly reliable light source apparatus by forming the enclosed space inside the concave reflector 181 with the front glass plate 191 and enclosing an inert gas such as the nitrogen gas 192 in the enclosed space.

Figure 14:
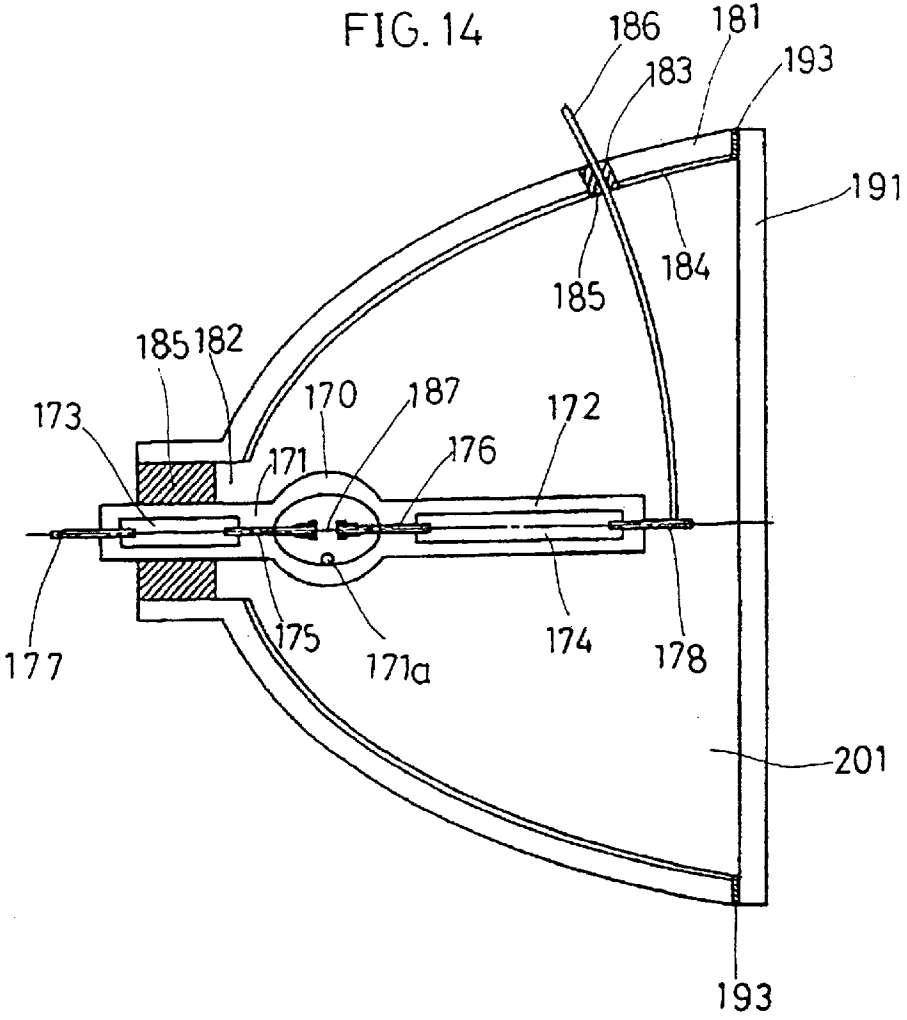
FIG. 14 is a schematic configurational view showing a fifth embodiment of the light source apparatus according to the present invention.

FIG. 14 exemplifies a configuration of a fifth embodiment of the light source apparatus according to the present invention. In FIG. 14, a reference numeral 201 denotes argon gas and other components of the fifth embodiment are the same as those of the embodiment shown in FIG. 13.

Different from the embodiment shown in FIG. 13, the fifth embodiment uses the argon gas 201 which is enclosed at a pressure of 30 atmospheric pressures in an enclosed space in the concave reflector 181. Generally speaking, a light emitting bulb of a discharge lamp is hazardous to be broken since a pressure in the light emitting bulb is extremely high and largely different from an external pressure while the discharge lamp stays lit.

The configuration shown in FIG. 14 allows an internal pressure of the emitting bulb to reach to a level on the order of 10 MPas (mega pascals) during ignition of the discharge lamp 170, but the argon gas 201 enclosed at the pressure of 30 atmospheric pressures in-the enclosed space reduces a difference between the internal pressure of the light emitting bulb and an external pressure, thereby remarkably moderating a breaking hazard of the light emitting bulb. Furthermore, the fifth embodiment provides, like the embodiment shown in FIG. 13, an effect to prevent oxidation of the metal foil 174 with the argon gas, thereby preventing the metal foil from being broken due to oxidation and enhancing reliability of the light source apparatus.

The concave reflector 181 may be an ellipsoidal mirror or a parabolic mirror: the ellipsoidal mirror which can have a large solid angle relative to a light emitting area of the pal being capable of enhancing a light condensing ratio. Furthermore, the ellipsoidal mirror permits the concave reflector 181 having a large depth in a direction of an optical axis and is suited to form an enclosed space by disposing the front glass plate 191.

An inert gas such as nitrogen gas may be enclosed at a predetermined pressure in place of argon gas to obtain a similar effect. Furthermore, the breaking hazard of the light emitting bulb can be remarkably moderated by enclosing air at a predetermined pressure though it does not provide the effect to prevent oxidation.

A gas may be enclosed at a predetermined pressure which is not lower than 1 atmospheric pressure and not higher than an internal pressure of the light emitting bulb during ignition of the discharge lamp.

The discharge lamp 170 may comprises a base which is fitted over the sealing member 171.

The effect described above can be obtained irresistive of lengths of the metal foils though the fifth embodiment uses the metal foils having different length as the discharge lamp.

The configuration according to the present invention is capable of preventing the light emitting bulb from being broken and permits composing a highly reliable light source apparatus by forming an enclosed space in a concave reflector using a front glass plate and enclosing a gas into a light emitting bulb at a pressure not lower than 1 atmospheric pressure and not higher than an internal pressure of the light emitting bulb during ignition of a lamp.

Figure 15:
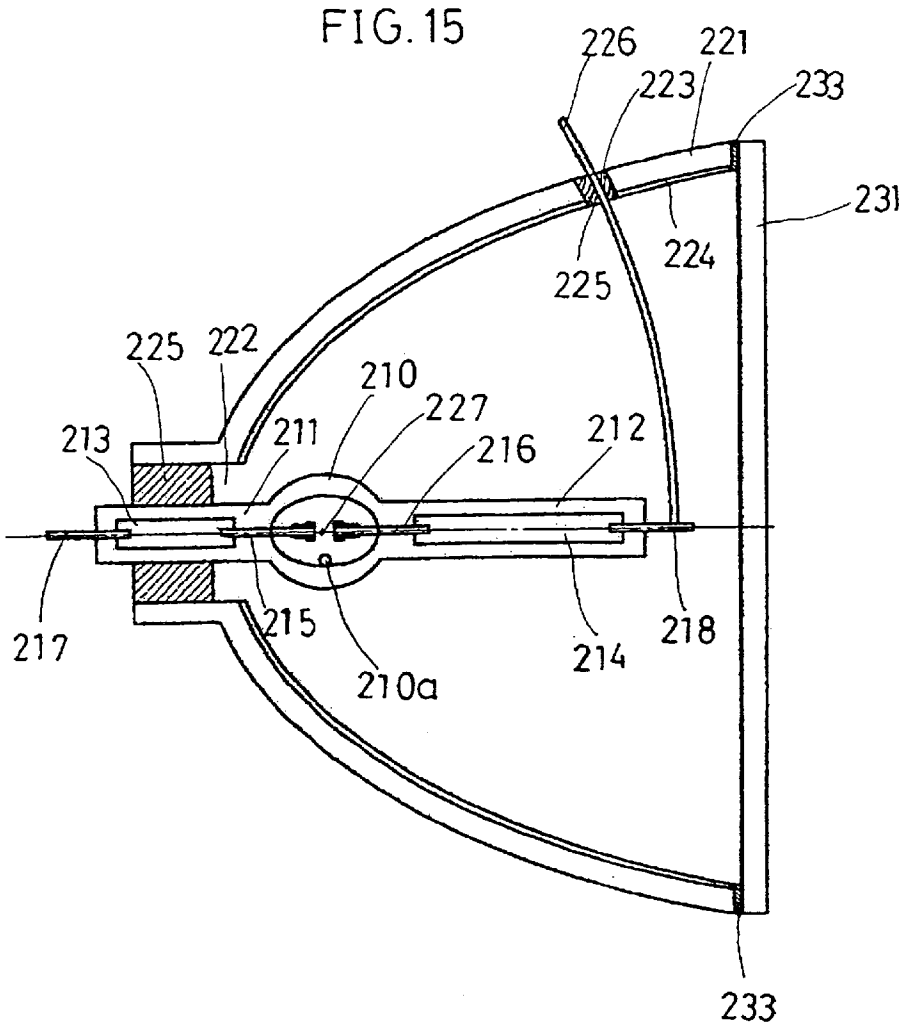
FIG. 15 is a schematic configurational view showing a sixth embodiment of the light source apparatus according to the present invention.

FIG. 15 exemplified a configuration of a sixth embodiment of the light source apparatus according to the present invention. In FIG. 15, a reference numeral 210 denotes a discharge lamp and a reference numeral 221 denotes a concave reflector.

The discharge lamp 210 is an ultra high pressure mercury vapor lamp to be ignited with an AC current and has a working pressure not lower than 10 MPas (mega pascals) during ignition. Therefore, a front glass plate is attached to an opening of a concave reflector to prevent glass pieces from splashing when the lamp is broken. The discharge lamp 210 has a position which is adjusted to insert a sealing member 211 in which a short metal foil 213 is sealed into an insert hole 222 of a concave reflector 221 and coincide a first focal point 227 of the concave reflector 221 approximately with a center between electrodes 215 and 216 of the lamp 210, and is fixed with an adhesive agent 225. Used as the adhesive agent 225 is an inorganic heat-resistant adhesive agent such as Sumiserum or the like.

An extension conductor 226 has an end connected to an external conductor 218 of the discharge lamp 210 and the other end pulled outside through a conductor outlet hole 223 of the concave reflector 221. A gap between the conductor outlet hole 223 and the extension conductor 226 is filled with the adhesive agent 225.

Mercury 210*a* can be evaporated to emit its characteristic rays by applying a predetermined voltage across the extension conductor 226 and the external conductor 217 to cause arc discharge between the electrodes 215 and 216.

The concave reflector is an ellipsoidal mirror as in the third embodiment (FIG. 12) described above, and a metal foil 214 has a length which is selected so that a distance as measured from a vertex of an ellipsoid on a side of the lamp insert hole 222 to an end of the metal foil 214 on a side of the opening does not exceed ½ of a length of a major axis of the concave reflector.

An inside surface of the concave reflector 221 has a reflective coating 224 made of a multi-layer film of a dielectric and efficiently reflects in a predetermined direction rays which are emitted from between the electrodes 215 and 216 of the discharge lamp 210.

The configuration shown in FIG. 15 wherein the sealing member 211 in which the short metal foil 213 is sealed is fixed in the insert hole 222 of the concave reflector 221 shortens a rearward protruding length of the lamp from the insert hole 222, thereby making it possible to configure the light source apparatus compact. The sealing member 211 can have a sufficient thermal capacity and a sufficient surface area since it is kept in contact with the concave reflector 221. Accordingly, the sealing member is capable of suppressing temperature rise due to heat conduction from a light emitting bulb and preventing the short metal foil 213 from being broken due to oxidation even when the foil is sealed in the sealing member. When a front glass plate 231 is attached to an opening of the concave reflector 221, on the other hand, an internal temperature of the concave reflector 221 is higher than that in a case where the front glass plate 231 is not attached and the metal foil 214 is heated to a higher temperature, but the sealing member 212 on the side of the opening of the concave reflector cannot be broken since the metal foil 214 which is sufficiently longer than the metal foil 213 is connected to the sealing member 212.

The concave reflector 221 is not limited to the ellipsoidal mirror and may be a parabolic mirror, but the ellipsoidal mirror can have a larger solid angle relative to a light emitting area of the lamp and provides a higher light condensing ratio. Furthermore, the ellipsoidal mirror 221 permits the concave reflector having a larger depth in a direction of an optical axis and is suited to form an enclosed structure by disposing the front glass plate.

It is extremely effective for compact configuration of the light source apparatus to configure the metal foil 213 on a side of the lamp insert hole 222 of the concave reflector 221 shorter than the metal foil 214 on a side of the opening.

An interior of the concave reflector may not be enclosed completely, but a vent hole may be formed in a portion of the concave reflector or the front glass plate to cool the discharge lamp and the concave reflector.

The discharge lamp 210 may comprise a base or the like fitted over the sealing member 211.

The configuration according to the present invention makes it possible to compose a highly reliable and compact light source apparatus by fixing the sealing member in which the short metal foil of the discharge lamp to the concave reflector as described above.

Figure 16:
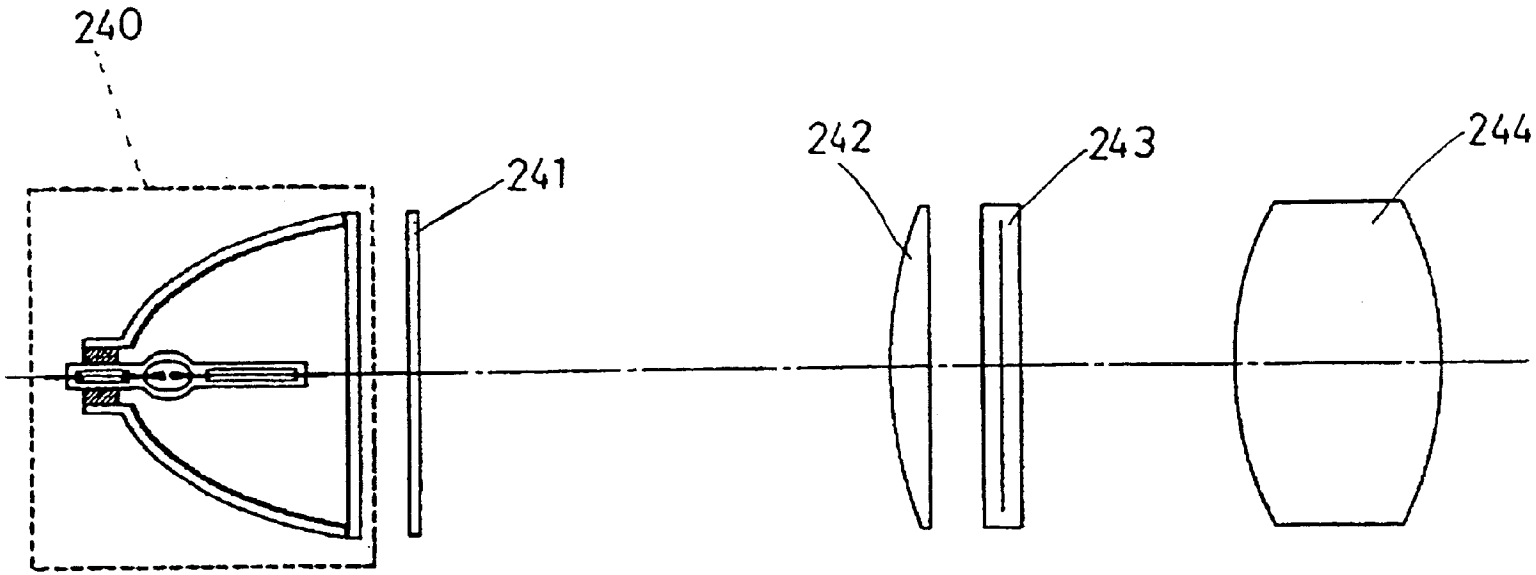
FIG. 16 is a schematic configurational view showing an embodiment of a projection display apparatus according to the present invention.

FIG. 16 exemplifies a configuration of the projection display apparatus according to the present invention. In FIG. 16, a reference numeral 240 denotes a light source, a reference numeral 241 denotes a UV-IR cut filter, a reference numeral 242 denotes a field lens, a reference numeral 243 denotes a liquid crystal panel and a reference numeral 244 denotes a projector lens.

The light source 240 is the same as the light source apparatus shown in FIG. 15 and a concrete configuration of the light source will not be described in particular.

After ultraviolet rays and infrared rays have been eliminated from rays emitted from the light source 240 by the UV-IR cut filter 241, the rays transmit through the field lens 242 and are incident on the liquid crystal panel 243. The field lens 242 condenses rays to illuminate the liquid crystal panel 243 onto the projector lens 244. The liquid crystal panel 243 modulates the incident rays according to video signals and forms an optical image on the liquid crystal panel 243. Rays transmitting through the liquid crystal panel 243 are incident onto the projector lens 244, which magnifies and projects the optical image on the liquid crystal panel onto a screen (not shown).

The configuration shown in FIG. 16 which uses the light source apparatus shown in FIG. 15 as the light source 240 is capable of enhancing a reliability of the projection display apparatus and permits configuring the apparatus compact.

Though the embodiment is described as an example wherein the light source apparatus shown in FIG. 15 is used as the light source 240, the light source apparatuses shown in any of FIGS. 10 through 14 can also provide effects to enhance a reliability of a projection display apparatus and configure the apparatus compact. The light source apparatus shown in FIG. 11, in particular, compact can efficiently condense rays emitted from the lamp, thereby enhancing luminance on a projection display apparatus.

An optical element, for example, a lens array or a polarized light converter element which leads the rays emitted from the light source 240 efficiently or uniformly to the liquid crystal panel 243 may be disposed between the light source 240 and the field lens 242.

Though the embodiment is described above as an example wherein only one transmission type liquid crystal panel is used as a spatial light modulator element, it is possible to use, for example, three transmission type liquid crystal panels, a liquid crystal panel which utilizes scattering or a spatial light modulator element which forms an optical image as variations of refraction or reflection according to the video signals. A projection display apparatus can provide similar effects so far as the apparatus forms an optical image by modulating rays emitted from a light source.

Furthermore, a back projection type projection display apparatus can be configured by using a transmission type screen.

As understood from the foregoing description, the present invention makes it possible to configure, by using the light source apparatus according to the present invention as a light source, a compact and bright projection display apparatus which illuminates a spatial light modulator element such as a liquid crystal panel with the light source and projects an optical image on the spatial light modulator element.

What is claimed is:

1. A discharge lamp comprising:

a light emitting bulb having two ends;

a sealing member located at each of said two ends of said light emitting bulb;

a pair of electrodes, one of which is sealed in each of said sealing members and located in said light emitting bulb opposing each other at a predetermined spacing; and a discharge medium enclosed in said light emitting bulb, wherein each of said electrodes comprises an electrode shaft and a discharge member integral with a tip of said electrode shaft and having an outside diameter larger than that of said electrode shaft, said discharge member having a taper formed on its tip, said electrode having a heat dissipating conductor located at an end opposite said discharge member and surrounding the electrode shaft, and wherein said discharge lamp satisfies the following conditions:

$$\phi/L \leqq 0.6$$

$$20° \leqq \theta \leqq 60°$$

where the reference symbol L denotes a spacing between said electrodes located in said light emitting bulb, the reference symbol $\phi$ denotes a diameter of the tip of the discharge member, and the reference symbol $\theta$ denotes an angle between said taper and said electrode shaft.

2. The discharge lamp according to claim 1, wherein said heat dissipating conductor is a coil.

3. The discharge lamp according to claim 1, wherein said electrodes and said heat dissipating conductor are made of different materials.

4. The discharge lamp according to claim 1, wherein said electrodes are made of tungsten doped with thorium.

5. The discharge lamp according to claim 1, wherein said discharge medium is mercury and a rare gas.

6. The discharge lamp according to claim 1, wherein said discharge lamp is for being lit by applying an AC voltage across said electrodes.

7. The discharge lamp according to claim 1, wherein said discharge lamp for being lit by applying an AC voltage across the electrodes, and a polarity of the voltage is reversed depending on the duration of time and number of times the lamp is lit.

8. The discharge lamp according to claim 1, wherein said electrodes are made of tungsten having a content of at least one of potassium, silicon and aluminum which does not exceed 10 ppm.

9. A light source apparatus comprising:

the discharge lamp according to claim 1; and a concave reflector which reflects rays emitted from said discharge lamp in a predetermined direction.

10. A projection display apparatus comprising:

a light source;

a spatial light modulator element which is illuminated by said light source and forms an optical image according to video signals; and projector means which projects the optical image formed on said spatial light modulator means on a screen, wherein said light source is the light source apparatus according to claim 9.

11. A light source apparatus comprising:

the discharge lamp according to claim 1; and a concave reflector which reflects rays emitted from said discharge lamp in a predetermined direction, wherein said concave reflector has an opening through which the reflected rays are emitted and a lamp insert hole located on a side opposite to said opening, wherein said discharge lamp is located so that an end of said discharge lamp is located in said lamp insert hole and a center of a light emitting area formed between a pair of electrodes is approximately coincident with a shorter focal point of said concave reflector, and wherein rays which are emitted from the center of said light emitting area and incident on an effective reflecting surface of said concave reflector are not intercepted by the electrodes of said discharge lamp.

12. A projection display apparatus comprising:

a light source;

an image forming means which is illuminated by said light source and forms an optical image according to video signals; and a projector means which projects the optical image formed on said image forming means on a screen, wherein said light source is the light source apparatus according to claim 11.

13. A discharge lamp comprising:

a light emitting bulb having two ends;

a sealing member located at each of said ends of said light emitting bulb;

a pair of electrodes, one of which is sealed in each of said sealing members and located in said light emitting bulb opposing the other at a predetermined spacing; and a discharge medium enclosed in said light emitting bulb, wherein each of said electrodes comprises an electrode shaft, a cylindrical conductor which is located over a tip of said electrode shaft and has a tapered surface located on an outer circumference on a side of the tip of said electrode, and a heat dissipating conductor which is located at the rear of said cylindrical conductor and surrounding said electrode shaft, and wherein said discharge lamp satisfies the following conditions:

$$\phi/L \leqq 0.6$$

$$20° \leqq \theta \leqq 60°$$

where the reference symbol L denotes a spacing between said electrodes located in said light emitting bulb, the reference symbol $\phi$ denotes an outside diameter of an end surface of said cylindrical conductor which is near the tip of said electrode shaft, and the reference symbol $\theta$ denotes an angle between said taper and said electrode shaft.

14. A discharge lamp comprising:

a light emitting bulb having two ends;

a sealing member located at each of said ends of said light emitting bulb;

a pair of electrodes, each electrode sealed in one of said sealing members and located in said light emitting bulb opposing each other at a predetermined spacing; and mercury and a rare gas enclosed in said light emitting bulb, wherein said mercury is present in an amount of 150 mg/cc or more, wherein each of said electrodes comprises an electrode shaft and a discharge member integral with a tip of said electrode shaft and having an outside diameter larger than that of said electrode shaft, said discharge member having a tapered surface located on its tip, said electrode having a heat dissipating conductor located at an end opposite said discharge member surrounding said electrode shaft, and wherein said discharge lamp satisfies the following conditions:

$$\phi/L \leqq 0.6$$

$$20° \leqq \theta \leqq 60°$$

where the reference symbol L denotes a spacing between said electrodes located in said light emitting bulb, the reference symbol $\phi$ denotes a diameter of the tip of said discharge member, and the reference symbol $\theta$ denotes an angle between said taper and said electrode shaft, such that said discharge lamp is lighted by applying an AC voltage across said electrodes.

15. A discharge lamp comprising:

a light emitting bulb having two ends;

sealing members located at each of said ends of said light emitting bulb;

a pair of electrodes, each electrode sealed in one of said sealing members and located in said light emitting bulb opposing the other at a predetermined spacing; and a discharge medium enclosed in said light emitting bulb, wherein each of said electrodes comprises an electrode shaft and a cylindrical conductor located over a tip of said electrode shaft, and having a heat dissipating conductor which is located at an end opposite said cylindrical conductor and surrounding said electrode shaft, wherein a tapered surface is located on an inside end portion of said cylindrical conductor which is distal from the tip of said electrode shaft.

16. The discharge lamp comprising:

a light emitting bulb having two ends;

a sealing member located at each of said ends of said light emitting bulb;

a pair of electrodes, each electrode sealed in one of said sealing members and located in said light emitting bulb opposing the other at a predetermined spacing;

a discharge medium enclosed in said light emitting bulb, wherein each of said electrodes comprises an electrode shaft and a discharge member integral with a tip of said electrode shaft and having an outside diameter larger than that of said electrode shaft, and a heat dissipating conductor located at an end opposite said discharge member and surrounding said electrode shaft, wherein said electrodes are located at a spacing not exceeding 2 mm and said discharge lamp satisfies the following conditions:

$$2.0 \leqq D2/D1 \leqq 5.0$$

$$D3/D1 \leqq 9.0$$

where the reference symbol D1 denotes an outside diameter of said electrode shaft, the reference symbol D2 denotes an outside diameter of said discharge member, and the reference symbol D3 denotes a length of said discharge member as measured in a direction of an electrode shaft.

17. The discharge lamp comprising:

a light emitting bulb having two ends;

sealing members located at each of said ends of said light emitting bulb;

a pair of electrodes, each electrode sealed in one of said sealing members and located in said light emitting bulb opposing the other at a predetermined spacing; and a discharge medium enclosed in said light emitting bulb, wherein each of said electrodes comprises an electrode shaft and a cylindrical conductor located over a tip of said electrode shaft, and having a heat dissipating conductor which is located at an end opposite said cylindrical conductor and surrounding said electrode shaft, wherein said electrodes are located at a spacing not exceeding 2 mm and said discharge lamp satisfies the following conditions:

$$2.0 \leqq D2/D1 \leqq 5.0$$

$$D3/D2 \leqq 9.0$$

where the reference symbol D1 denotes an outside diameter of the electrode shaft, the reference symbol D2 denotes an outside diameter of the cylindrical conductor, and the reference symbol D3 denotes a length of said cylindrical conductor as measured in a direction of an electrode shaft.

* * * * *